US005682583A

United States Patent [19]

Ito et al.

[11] Patent Number: 5,682,583

[45] Date of Patent: Oct. 28, 1997

[54] DEVELOPING DEVICE FOR MIXING AND SUPPLYING DEVELOPER

[75] Inventors: Noboru Ito, Kawanishi; Yoshihiro Shojo; Katsuhiko Takeda, both of Itami, all of Japan

[73] Assignee: Minolta Camera Kabushiki Kaisha, Osaka, Japan

[21] Appl. No.: 257,184

[22] Filed: Jun. 8, 1994

[30] Foreign Application Priority Data

| | | | |
|---|---|---|---|
| Jun. 10, 1993 | [JP] | Japan | 5-166227 |
| Jun. 16, 1993 | [JP] | Japan | 5-171044 |
| Sep. 3, 1993 | [JP] | Japan | 5-243700 |
| Oct. 18, 1993 | [JP] | Japan | 5-284358 |

[51] Int. Cl.[6] ..... G03G 15/08

[52] U.S. Cl. ..... 399/254; 399/255

[58] Field of Search ..... 355/245, 260, 355/251, 253; 118/653; 399/254, 255, 256

[56] References Cited

U.S. PATENT DOCUMENTS

| | | | |
|---|---|---|---|
| 4,435,065 | 3/1984 | Wada | 118/653 |
| 4,481,903 | 11/1984 | Haberhauer et al. | 118/653 |
| 4,954,844 | 9/1990 | Morita et al. | 355/245 |
| 4,987,452 | 1/1991 | Nakagawa et al. | 355/245 |
| 4,996,565 | 2/1991 | Herley | 355/245 |
| 5,012,285 | 4/1991 | Oka et al. | 355/245 |
| 5,143,017 | 9/1992 | Haneda et al. . | |
| 5,160,968 | 11/1992 | Yamada et al. | 355/208 |
| 5,166,732 | 11/1992 | Fuji | 355/245 |

FOREIGN PATENT DOCUMENTS

| | | |
|---|---|---|
| 63-150962 | 4/1988 | Japan . |
| 1-167866 | 7/1989 | Japan . |

*Primary Examiner*—William J. Royer

*Attorney, Agent, or Firm*—Burns, Doane, Swecker & Mathis, LLP

[57] ABSTRACT

A developing device having a developing sleeve opposed to a photoreceptor, and a developer transport portion adjacent to the sleeve. The developer transport portion is divided into first and second portions by a partition, and the developer is circulated between the first and second portions. A fresh toner is supplied to the developer in the second portion to be transported to the first portion while being mixed, and thereafter is supplied to the sleeve along an axial direction of the sleeve in the first portion. The second portion is provided with a transport member by which the developer is transported at an upstream side of the second portion with respect to the developer transport direction in the second portion with a speed faster than the toner supply speed and the transport speed of the developer at a downstream side of the first portion with respect to the developer transport direction in the second portion.

23 Claims, 33 Drawing Sheets

Q2 / Q1=0

Q2/Q1=0.67

Q2/Q1=1.0

Q2/Q1 = 1.5

Q2/Q1 = 4.0

Q2/Q1 = 6.0

DEVELOPING DEVICE FOR MIXING AND SUPPLYING DEVELOPER

BACKGROUND OF THE INVENTION

1. Field of the Invention

The present invention relates to a developing device for use in image forming apparatus such as copying machines, printers and the like. Preferably, the present invention relates to a developing device provided with a developer supplying section for supplying developer to a developing sleeve while transporting said developer in a predetermined direction along an axis of said developing sleeve, and a developer transporting section for transporting developer in a direction opposite to the transporting direction of the developer supplying section while mixing said developer, so as to circulate said developer between said developer supplying section and said developer transporting section.

2. Description of the Related Art

Conventional image forming apparatus such as copying machines, printers and the like are typically provided with well known developing devices employing a monocomponent developing method using a developer comprising toner alone, or a two-component developing method using a developer comprising a toner and a carrier, said developing devices accomplish developing by supplying toner from said developing device to an electrostatic latent image formed on the surface of an image-carrying member.

In developing devices employing a two-component developing method using a developer comprising a toner and a carrier, when toner is supplied to an image-carrying member to accomplish development, the density of the toner contained in the developer is reduced, such that new toner is resupplied when the density of the toner contained in the developer is reduced to a certain degree.

It is known that the developing device resupplies toner along a line in the axial direction of the developing sleeve, as shown in the developing device of FIGS. 1 and 2. The developing device shown in FIGS. 1 and 2 is provided with a developer transport section 11 for transporting developer 1 while mixing the developer, and a toner supply section 12 for supplying toner and arranged so as to be connected to the developer transport section 11 on the upstream side of said transport section 11 in the direction of transport. In this device, fresh toner is supplied directly from a toner bottle (not illustrated) or the like provided in the toner supply section, said fresh toner being delivered through the toner supply section 12 to the upstream side of the developer transport section 11 in the transport direction. In general, the developing device shown in FIGS. 1 and 2 is advantageous inasmuch as it has a simpler and more compact toner supplying mechanism compared to a developing device which linearly resupplies toner in a line, thereby counteracting localized toner consumption and the like.

In the developing device describes in FIGS. 1 and 2, a mixing/transport member 13 is provided to mix the developing material 1 and transport said developing material 1 in the arrow "a" direction. The mixing/transport member 13 is provided with a mixing transport impeller blade **13*b* of uniform spiral shape on the exterior of a rotating shaft 13*a*. The mixing/transport impeller blade 13 is rotated so as to mix and transport the developer 1 at the same time, and the mixed and transported developer 1 is delivered to the developer supply section 14 via a supply aperture 15*a* provided at one end of the partition 15 which separates the developer transport section 11 and the developer supply section 14**.

A bucket roller 16 is generally provided within the developer supply section 14 to deliver the toner, as shown in FIGS. 1 and 2. This bucket roller 16 is rotated so as to deliver the transported developer 1 in the opposite direction to the transport in the developer transport section 11, and a portion of said developer 1 is supplied to the developing sleeve 18 provided on the magnet roller 17 within the developer supply section 14. The developer 1 is conducted to the image-carrying member 2 via the aforesaid developing sleeve 18 so as to develop the latent image formed on the image-carrying member 2 by supplying toner thereto, such that the developer 1 transported in the direction opposite the transport direction of the developer transport section 11 is returned to the developer transport section 11 through the return aperture **15*b* provided at the other end of the aforesaid partition 15. Thus, the developer 1 is circulated between the developer transport section 11 and the developer supply section 14**.

When the developer 1 is conducted to the image-carrying member 2 by the developing sleeve 18 as previously described, the toner density within the developer 1 is reduced because the toner is supplied to said image-carrying member 2 to accomplish development, and, therefore, fresh toner is supplied directly from the toner bottle or the like to the aforesaid toner supply section 12. Thus, the fresh resupplied toner is conducted through the toner supply section 12 to the developer transport section 11 via the rotation of the mixing/transport member 13, so as to be delivered to the developer 1 returned through the return aperture **15*b* to the developer transport section 11. Then, the developer 1 which has received the resupplied toner is mixed and transported by the mixing/transport member 13**.

However, when the aforesaid fresh resupplied toner is conducted through toner resupply section 12 to the developer transport section 11 and the toner is returned through the return aperture **15*b* to the developer transport section 11 and mixed with said developer 1, the toner density is increased in the developer 1 only in that portion supplied with fresh toner, producing a partial nonuniformity of toner density in the developer 1. As the result, the fresh resupplied toner is inadequately charged. The aforesaid inadequately charged toner is transported to the developer supply section 14 and supplied to the developing sleeve 18**, such that background fog is produced when said toner is used for developing. A further disadvantage is that the aforesaid inadequately charged toner is subject to scattering from the developing device and causes soiling of within the image forming apparatus.

Because the fresh resupplied toner within the developer transport section 11 is inadequately charged, the developer 1 becomes fatigued when said developer 1 is vigorously mixed by the mixing/transport member 13, thereby producing new disadvantages such as greatly increasing the load on the mixing/transport member 13.

Also well known are developing devices having constructions such as shown in FIGS. 3–5. In this developing device, a partition 160 is provided within the housing 100. This partition 160 separates the first transport section 130 for mixing and transporting the developer 1 along the axial direction of the developing sleeve 110 on the developing sleeve 110 slide for delivering developer 1 to the image-carrying member 2, and the second transport section 150 for mixing the developer 1 and transporting the developer 1 in the opposite direction to that of the aforesaid first transport section 130. The developing material in the aforesaid transport section 130 is supplied to the developing sleeve 110 and fresh toner is supplied from the toner resupply section 170 to the aforesaid second transport section 150 side. The previously mentioned first transport section 130 is arranged horizontally, and within said first transport section 130 is arranged a first transport roller 120 having a transport impeller blade 120b on the exterior of a rotating shaft 120a and a lifting member 120c for uplifting the developer 1. When the first transport roller 120 is rotated, the developer 1 within the first transport section 130 is transported along the axial direction of the developing sleeve 110, such that a portion of said transported developer 1 is supplied to the developing sleeve 18. At the same time, the second transport section 150 is arranged so as to be inclined upwardly from the upstream side to the downstream side in the transport direction of the developer 1, and within said second transport section 150 is disposed a second transport roller 140 having a spiral shape transport impeller blade 140b on the exterior of a rotating shaft 140a. When the second transport roller 140 is rotated, the developer 1 is mixed within the second transport section 150 and transported in a direction opposite to that of the first transport section 130.

Furthermore, the height of the partition 160 separating the first transport section 130 and the second transport section 150 within the housing 100 may be made higher so as to prevent overflow of the developer 1 over said partition 160 and prevent movement of said developer 1 between the said first transport section 130 and said second transport section 150. A supply aperture 160a is provided at one end of the aforesaid partition 160 to allow the developer 1 to move from the second transport section 150 to the first transport section 130, and a return aperture 160b is provided at the other end of the partition 160 to allow developer 1 to move from the first transport section 130 to the second transport section 150.

In the previously described developing device, the rotating shaft 140a of the second transport roller 140 provided within the second transport section 150 is rotated, so as to mix and simultaneously transport the developer 1 by means of the transport impeller blades 140b provided on the exterior of said rotating shaft 140a. The developer 1 thus mixed and transported passes through the supply aperture 160a provided at one end of the previously mentioned partition 160 so as to be delivered to the first transport section 130.

On the other hand, in the first transport section 130 to which the aforesaid developer 1 has been delivered, a rotating shaft 120a of the first transport roller 120 provided within the first transport section 130 is rotated, so as to lift the developer 1 by means of the lifting member 120c provided on the exterior of said rotating shaft 120a. A portion of the developer 1 is supplied to the developing sleeve 110 provided with an internal magnet roller 180, and said developer 1 supplied by the developing sleeve 180 is conducted to the image-carrying member 2, whereupon the toner within said developer 1 is supplied to the image-carrying member 2 to accomplish development of the latent image. The developer 1 is transported in a direction opposite that of the second transport section 150 by means of the transport impeller blades 120b provided on the exterior of the aforesaid rotating shaft 120a, such that the thus transported developer 1 passes through the return aperture 160b provided at the other end of the aforesaid partition 160 and is returned to the second transport section 150. Thus, the developer 1 is circulated between the second transport section 150 and the first transport section 13.

When the toner density in the developer 1 is reduced as a result of developing accomplished by supplying toner in the developer 1 from the developing sleeve 110 to the image-carrying member 2, fresh toner is resupplied from the toner resupply section 170 to the second transport section 150, said resupplied fresh toner passes through the return aperture 160b so as to be returned to the second transport section 150 together with the developer 1. This toner is then mixed with the developer 1 for transport by the aforesaid second transport roller 140.

In the same manner as previously described relative to the conventional developing device shown in FIGS. 1 and 2, when the resupplied fresh toner passes through the toner resupply section 170 and is mixed with the developer 1 in the second transport section 150, the toner density increases in the developer 1 only in that portion supplied with fresh toner, producing a partial nonuniformity of toner density in the developer 1. In instances where a large amount of toner is consumed in particular, when a large amount of toner is resupplied at one time from the toner resupply section 170, toner density is markedly increased only in that portion of the developer 1 receiving the resupplied toner, such that the developer 1 is transported with the fresh resupplied toner in an inadequately mixed state, resulting in the developer 1 being transported to the supply aperture 160a without sufficient toner charging.

The developer containing the inadequately charged toner passes through the supply aperture 160a to the first transport section 130. When the developer 1 containing the inadequately charged toner is supplied to the developing sleeve 110 and used to develop a latent image, background fogging appears in the formed image. A further disadvantage is the scattering of the inadequately charged toner from the developing device, thereby soiling the interior of the image forming apparatus.

Furthermore, if the developer 1 is mixed more vigorously by the second transport roller 140 in order to achieve adequate charging of the fresh resupplied toner within the second transport section 150, the developer 1 becomes fatigued due to the excessive load thereon by such action, thereby producing an additional disadvantage in increasing the load applied to the second transport roller 140.

SUMMARY OF THE INVENTION

A main object of the present invention is to provide a developing device capable of forming excellent images.

A further object of the present invention is to provide a developing device capable of supplying developer containing adequately charged toner to an image-carrying member.

A still further object of the present invention is to provide a two-component developing device comprising a developer supply section for supplying developer to a developing sleeve, and a developer transport section for transporting and mixing said developer, and which is constructed so as to circulate the developer between said developer supply section and said developer transport section, said developing device being capable of supplying the toner contained in the developer onto the surface of an image-carrying member with said toner in an adequately charged state.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 6:
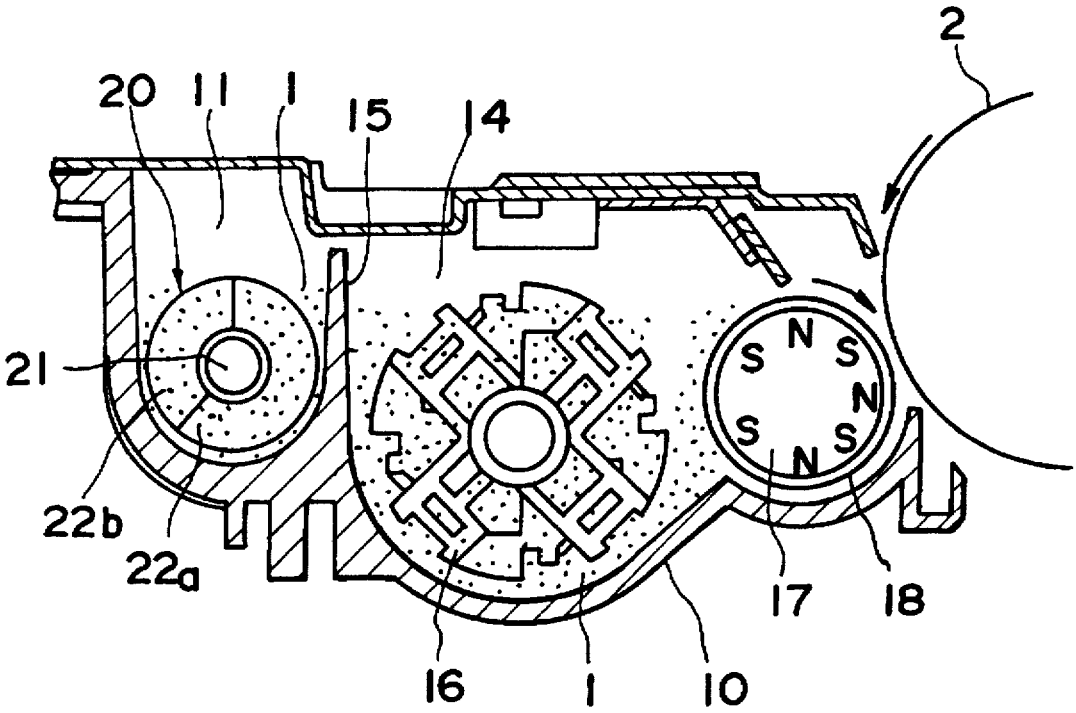
FIG. 6 is a brief section view showing the interior of a first embodiment of the developing device of the present invention as viewed from the side.

As shown in FIG. 6, the first embodiment of the developing device of the present invention is provided with a developing sleeve 18 having a built-in magnetic roller 17 and rotatably disposed at a part of an opening formed in the housing 10 opposite the image-carrying member 2. A partition 15 is provided along the axis of rotation of the developing sleeve 18 within the housing 10. The aforesaid partition 15 separates the developer supply section 14 and the developer transport section 11 in the housing 10. The developer supply section 14 transport the developer 1 comprising a toner and a carrier along the rotational axis of the developing sleeve 18 so as to supply said developer 1 to the surface of said developing sleeve 18. The developer transport section 11 mixes the developer 1 and transports said developer 1 in the arrow "a" direction.

Figure 8A:
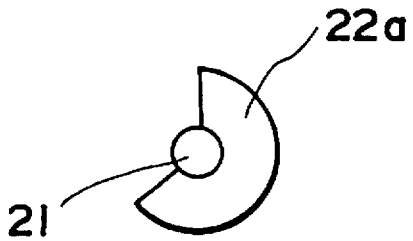
FIGS. 8A and 8B are illustrations showing the condition of each mixing/transport impeller blade provided on the exterior of the rotating shaft of the mixing/transport means in the developing device of the first embodiment of the invention.
Figure 8B:
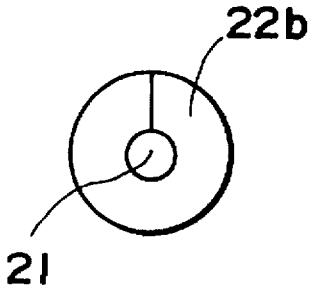

As shown in FIG. 8, a toner supply section 12 is provided upstream from the developer transport section 11 in the transport direction so as to be connected with the developer transport section 11 for supplying toner into said developer supply section 11. Mixing/transport means 20 are provided in the toner supply section 12 and developer transport section 11 to mix and transport the developer 1.

Figure 7:
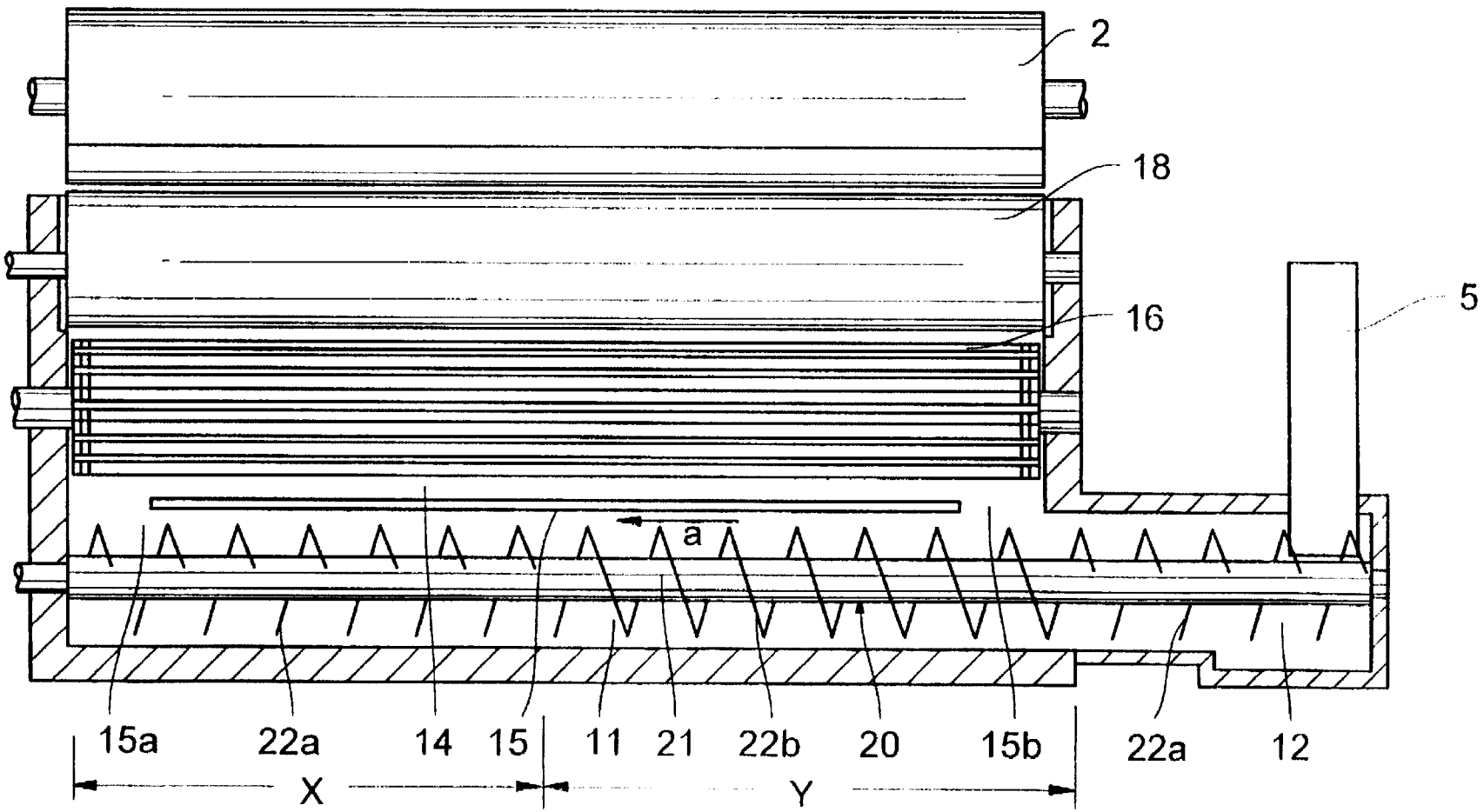
FIG. 7 is a brief section view showing the interior of the developing device of the first embodiment of the invention as viewed from the top.

As shown in FIGS. 6–8, the mixing/transport means 20 is provided with a rotating shaft 21 disposed along the transport section 11 and supply section 12. As shown in FIG. 7, a mixing/transport impeller blade 22*a* is provided on the exterior of the rotating shaft 21 positioned at area X of the toner supply section 12 and developer transport section 11. The mixing/transport impeller blade 22*a* has a spiral configuration with a notch of ⅓ of a circle, as shown in FIG. 8A. On the other hand, a raking/transport impeller blade 22*b* is provided on the exterior of the rotating shaft 21 positioned at area Y of the developer transport section 11 (refer to FIG. 7). The mixing/transport impeller blade 22*b* has a notchless spiral configuration, as shown in FIG. 3B.

When the rotating shaft 21 of the mixing/transport means 20 having the previously described construction is rotated, the developer 1 is mixed by the mixing/transport impeller blades 22*a* and 22*b* provided on the exterior of said rotating shaft as the developer 1 is transported into the developer transport section 11. The developer 1 which is delivered into the developer transport section 11 is fed into the developer supply section 14 through the supply aperture 15*a* provided at one end of the partition 15, as shown in FIG. 7.

A rotatable bucket roller 15 is provided along the developer supply section 14 to which the developer 1 is delivered. The developer 1 delivered into the supply section 14 is transported in the opposite direction via the rotation of the bucket roller 15, and a portion of said developer 1 is supplied to the developing sleeve 18. The developer 1 is then supplied to the image-carrying member 2 via the aforesaid developing sleeve 18, thereby developing the electrostatic latent image formed on the surface of the image-carrying member 2. The developer 1 transported in a direction opposite to the arrow "a" direction via the rotation of the bucket roller 16 is returned to the developer transport section 11 through the return aperture 15*b* provided at the other end of the partition 15 (refer to FIG. 7).

When the density of the toner in the developer 1 is reduced after said developer 1 is supplied to the image-carrying member 2 for development, fresh toner is resupplied directly from a toner bottle or the like 5 to the toner supply section 12. The supplied toner is transported from the toner supply section 12 into the developer transport section 11 via the mixing/transporting means 20, and is mixed with the developer 1 returned to the transport section 11 through the return aperture **15*b*. The mixed toner and developer 1 is then delivered into the developer transport section 11 while being mixed via the mixing/transporting means 20**.

When the developer 1 is mixed and transported within the developer transporting section 11 by the mixing/transporting means 20 of the previously described construction, the transport speed of the developer 1 in area Y of the developer transport section 11 is faster than the transport speed of the toner supplied from the toner supply section 12 and the transport speed of the developer 1 in the area X of developer transport section 11. The reason for this is the developer 1 is transported by the notched mixing/transporting impeller blade **22*a* in the toner supply section 12 and in the area X of developer transport section 11, whereas the developer 1 is transported by the notchless mixing/transporting impeller blade 22*b* in the area Y of the developer transport section 11. The speed of toner transport in the toner supply section 12 and the speed of developer transport in the area X of developer transport section 11 is ⅔ the speed of developer transport in the area Y of the developer transport section 11**.

Thus, when the transport speed of the developer 1 in the area Y of the developer transport section 11 is greater than the transport speed of the toner delivered through the toner supply section 12 to the developer transport section 11, the toner is gradually supplied to the developer 1, such that the occurrence of locally high toner density in the developer 1 is reduced.

When the developer 1 that has been supplied with toner is transported rapidly in the area Y of the developer transport section 11 and reaches the area X of the developer transport section 11, said developer 1 is sufficiently mixed by the slower transport in area X of the developer transport section 11, such that the toner in the developer 1 becomes adequately charged.

A second embodiment of the invention is described hereinafter.

The developing device of the second embodiment has a construction identical to that of the first embodiment with the exception of the mixing/transporting means 23 for mixing and transporting the developer 1 in the developer transport section 11. Therefore, only the construction of the mixing/transporting means 23 is described herein.

Figure 9:
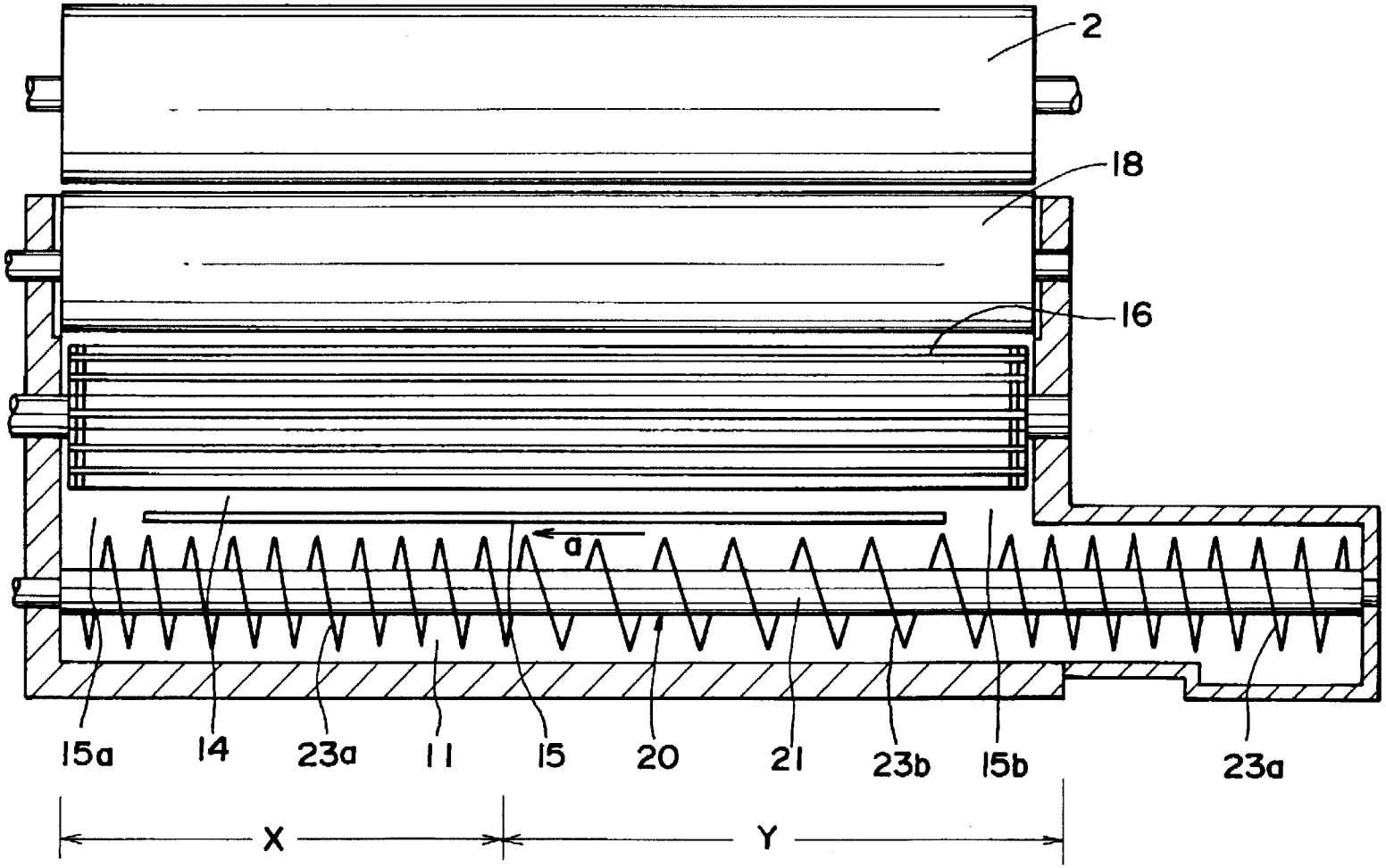
FIG. 9 is a brief section view showing the interior of the developing device of a second embodiment of the invention as viewed from the top.

The mixing/transporting means 23 of the second embodiment of the developing device of the present invention is provided with a rotating shaft 21 arranged along the developer transport section 11 and the toner supply section 12, as shown in FIG. 9. A mixing blade **23*a* having a spiral configuration with a pitch of 7 mm is provided on the exterior of the rotating shaft 21 positioned at area X of the developer transport section 11 and the toner supply section 12. On the other hand, a mixing blade 23*b* having a spiral configuration with a pitch of 10 mm is provided on the exterior of the rotating shaft 21 positioned at area Y of the developer transport section 11**.

Using the aforesaid mixing/transporting means 23, the toner is supplied through the toner supply section 12 to the developer transport section 11 and thereafter is mixed and transported within the developer transport section 11 together with the developer 1 which has received the toner returned through the return aperture **15*b* to the developer transport section 11, in the same manner as in the first embodiment. Thus, in the aforesaid mixing/transporting means 23, the transport speed of the toner in the toner supply section 12 and the transport speed of the developer 1 in the area X of the developer transport section 11 provided with the mixing/transporting blade 23*a* of spiral configuration and narrow 7 mm pitch is slower than the transporting speed of the developer 1 in the area Y of the developer transporting section 11 provided with the mixing/transporting blade 23*b*** of spiral configuration and wide 10 mm pitch.

The result of the faster transport speed of the developer 1 in the area Y of the developer transport section 11 relative to the transport speed of the toner fed through the toner supply section 12 to the developer transport section 11 is identical to that of the first embodiment such that the toner is supplied gradually to the developer 1, thereby reducing locally high toner density in said developer 1. Furthermore, the developer 1 is adequately mixed in the area X of the transport section having the slower developer transport speed, thereby adequately charging the supplied toner in the same manner as in the first embodiment even when the developer 1 which has been supplied with toner in the aforesaid manner is mixed in the area Y of the developer transport section 11 and rapidly transported to the area X of the developer transport section 11.

Figure 1:
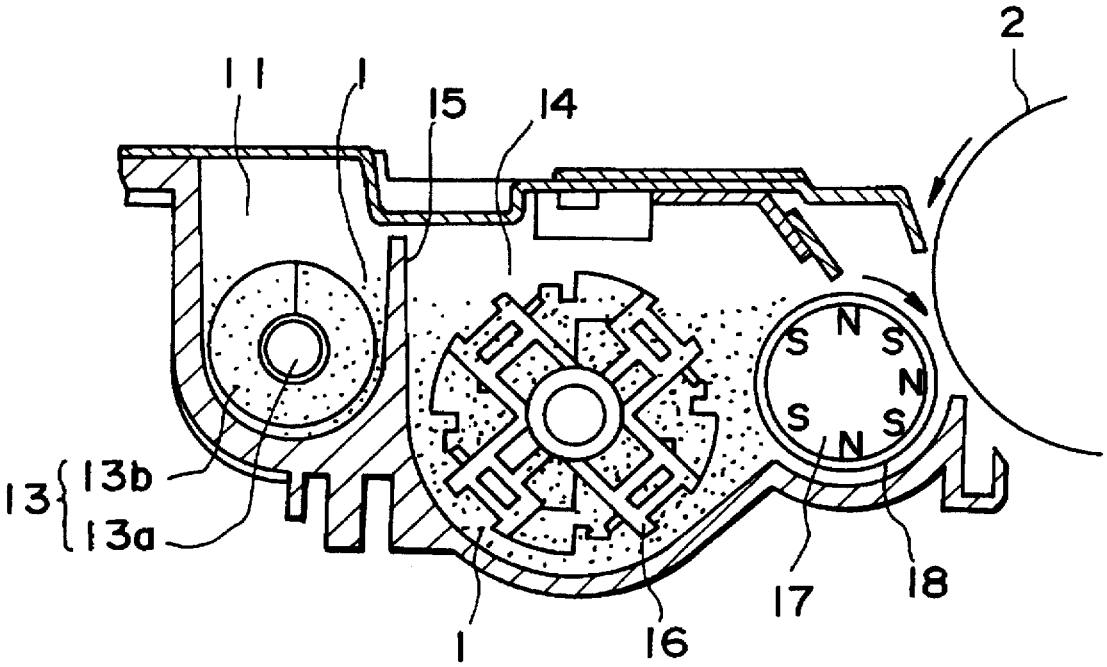
FIG. 1 Prior Art
FIG. 1 is a brief section view showing the interior of a conventional developing device as viewed from the side.
Figure 2:
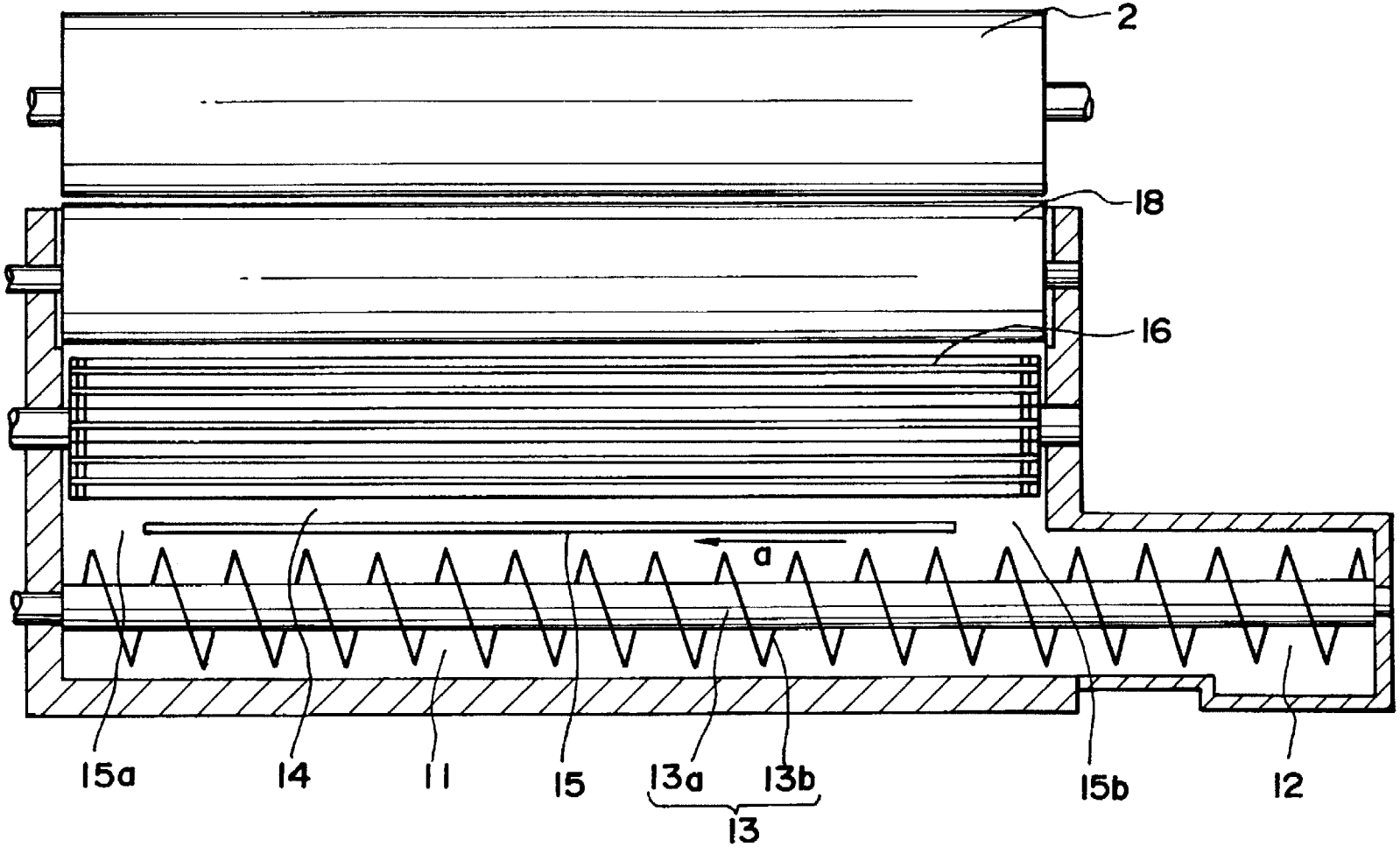
FIG.2 Prior Art
FIG. 2 is a brief section view showing the developing device of FIG. 1 as viewed from the top.

The developing devices of the first and second embodiments and a conventional developing device using a mixing/transporting member 13 provided with a mixing/transporting blade **13*b* having a spiral configuration of uniform shape disposed on the exterior of a rotating shaft 13*a*, as shown in FIGS. 1 and 2**, were subjected to actual testing at a copy speed of 40 copies per minute (cpm).

The aforesaid tests using the developing devices of the first and second embodiments produced excellent images with superior stability and without instances of scattered toner outside the developing device, nonuniform toner charging, background fogging, or irregular copy densities. On the other hand, these tests using the aforesaid conventional developing apparatus did produce significant toner scattering outside the developing device, nonuniform toner charging, background fogging, and irregular copy densities. In the developing devices of the first and second embodiments, nonuniform toner density in the developer 1 was less than ½ that of the conventional developing device, indicating that toner and developer 1 mixing efficiency was excellent.

Although the developing devices of the first and second embodiments employ as the mixing/transporting means 23 a member provided with mixing/transporting impeller blade **22*a* having a notched spiral configuration and mixing/transporting impeller blades 22*b* having a notchless spiral configuration on the exterior of a rotating shaft 21, and a mixing/transporting blade 23*a* having a spiral configuration and narrow pitch and mixing/transporting blade 23*b* having a spiral configuration and larger pitch on the exterior of a rotating shaft 21, it is to be noted that the mixing/transporting means is not specifically limited to these configurations. For example, an alternative arrangement not shown in the illustrations might provide for a mixing/transporting member on the exterior of which a lifting member is provided, e.g., a bucket roller, wherein the transporting blade(s) contained therein is reduced in the area X of the developer transport section 11 and the toner supply section 12, such that the transport speed of the developer in the area Y of the developer transport section 11 is faster than the transport speed of the developer in the area X of the developer transport section 11 and the transport speed of the toner delivered through the toner supply section 12**.

A third embodiment of the invention is described hereinafter.

The construction of the developing device of the third embodiment is identical to that of the first embodiment with the exception of the housing 110, developer supply section 114, developer transport section 111, and partition 115. Accordingly, only these unlike components are discussed hereinafter.

In the developing device of the third embodiment, the first and second transport rollers 32 and 33 for transporting the developer 1 in the developer supply section 114 and the developer transport section 111 are provided with, on the exterior of the rotating shafts 32*a* and 33*a*, transport blades 32*b* and 32*b* for transporting the developer 1, and lifting members 32*c* and 33*c* for lifting the developer 1. These first and second transport rollers 32 and 33 are arranged in the developer supply section 114 and developer transport section 111 such that the lifting members 32*c* and 33*c* are mutually opposed at positions mutually opposite the partition 115.

Figure 11:
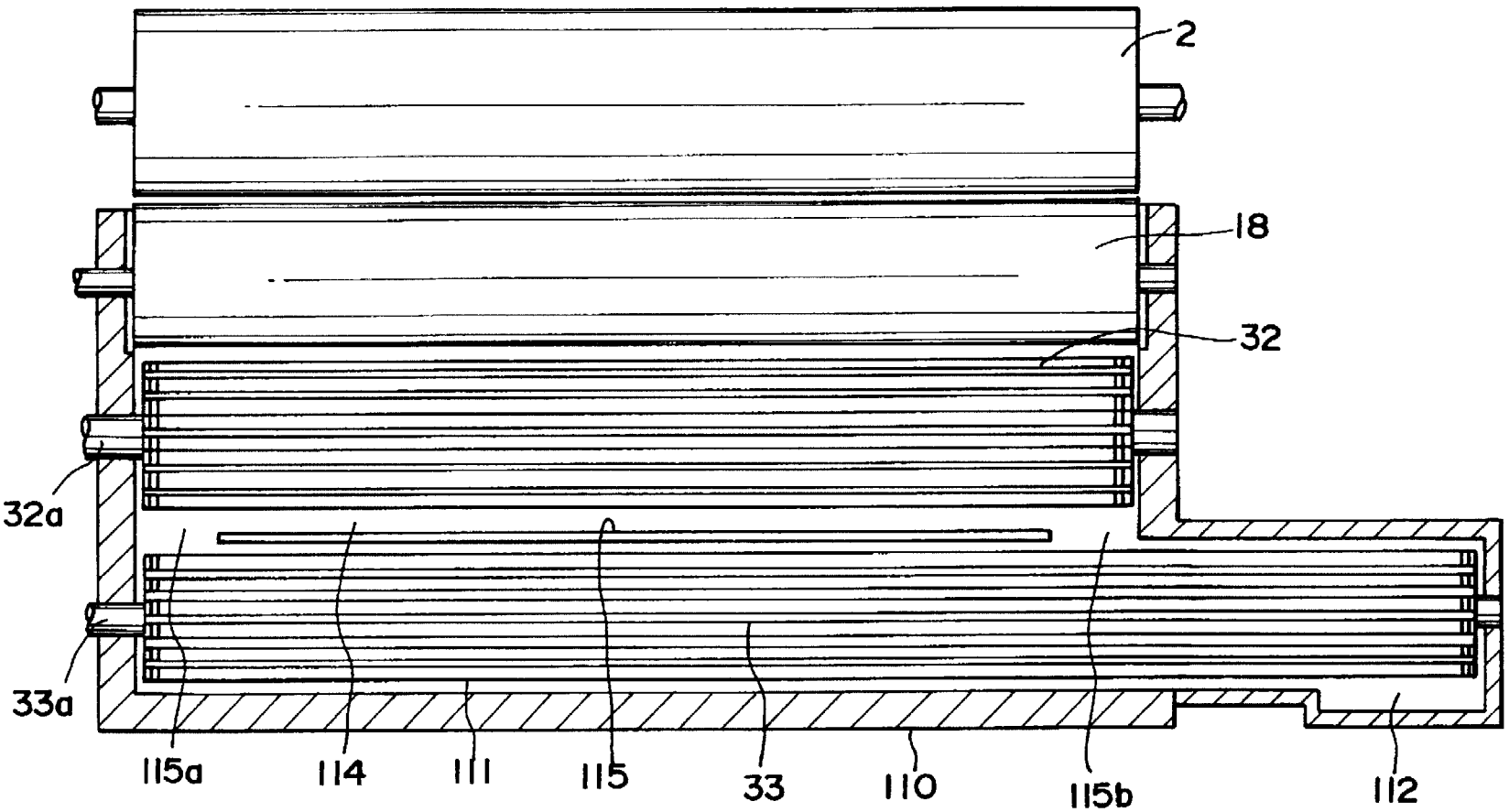
FIG. 11 is a brief section view showing the interior of the developing device of the third embodiment of the invention as viewed from the top.

In the partition 115 which divides the developer supply section 114 and the developer transport section 111, a supply aperture 115*a* is provided at one end thereof for supplying developer 1 from the developer transport section 111 to the developer supply section 114, and a return aperture 115*b* is provided at the other end thereof for returning developer 1 from the developer supply section 114 to the developer transport section 111, as shown in FIG. 11.

Figure 10:
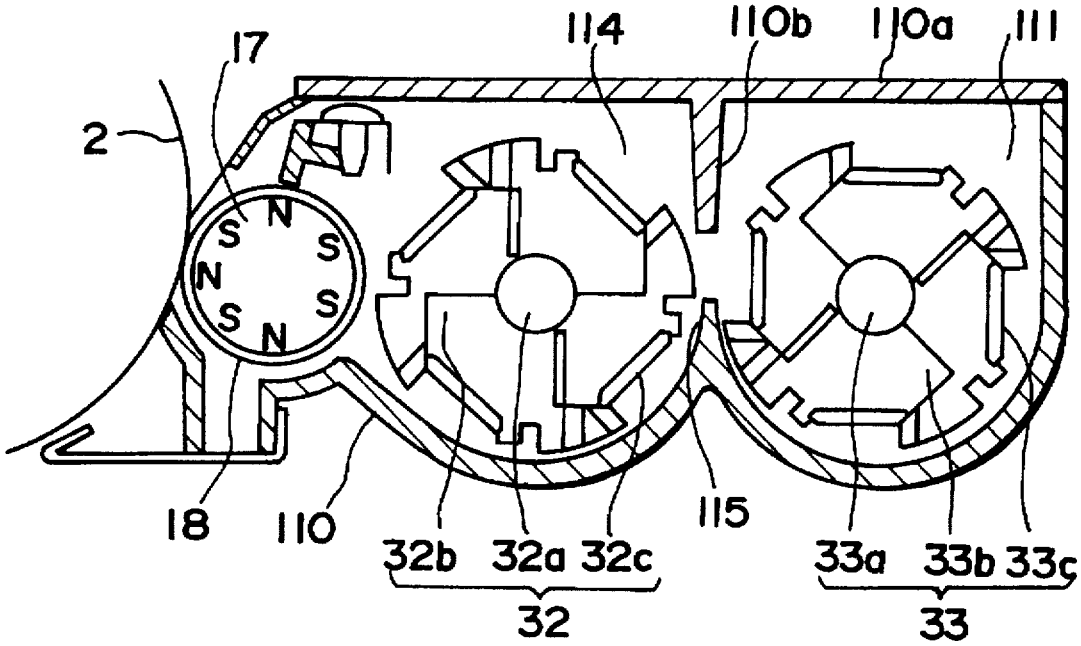
FIG. 10 is a brief section view interior of the developing device of a third embodiment of the invention as viewed from the side.

In the developing device of the third embodiment, the height of the partition 115 is set at a height that allows a part of the developer 1 lifted by means of the lifting members 32*c* and 33*c* provided on the transport rollers 32 and 33 to be moved between the developer transport section 111 and the developer supply section 114, as shown in FIG. 10. A descending partition 110*b* is integrally provided on the cover 110*a* of the previously mentioned housing 110, so as to be opposite the aforesaid partition 115 at a predetermined distance.

The part of the developer 1 lifted by means of the aforesaid lifting members 32*c* and 33*c* is moved through the open portion between the descending partition 110*b* and the partition 115 so as to be moved between the developer transport section 111 and the developer supply section 114. The descending partition 110*b* prevents the movement of airborne developer 1 lifted by the lifting members 32*c* and 33*c* in excess of requirements between the developer transport section 111 and the developer supply section 114. The height of the partition 115 is generally set lower than ⅓ the radius of the first and second transport rollers 32 and 33 in a vertical direction from a line connecting the axial centers of said rollers 32 and 33 so as to allow movement of part of the developer 1 lifted by means of the lifting members 32*c* and 33*c* provided on the first and second transport rollers 32 and 33 between developer transport section 111 and the developer supply section 114. On the other hand, the bottom edge of the descending partition 110*b* provided opposite the aforesaid partition 115 is generally set higher than a position ⅓ the radius of the transport rollers 32 and 33 from a line connecting the axial centers of said transport rollers 32 and 33 so as to prevent the movement of airborne developer 1 lifted by the lifting members 32*c* and 33*c* in excess of requirements between the developer transport section 111 and the developer supply section 114.

In the developing device of the third embodiment, when developing by supplying toner to an electrostatic latent image formed on image-carrying member 2, the transport rollers 32 and 33 provided in the developer supply section 114 and developer transport section 111 are rotated via their respective rotating shafts 32*a* and 33*a*, such that the developer 1 in the developer supply section 114 and the developer transport section 111 is transported in the reverse direction to the direction in said developer supply section 114 and the developer transport section 111 via the transport blades 32*b* and 33*b* provided on said transport rollers 32 and 33. At the same time, the developer 1 in the developer supply section 114 and the developer transport section 111 is lifted by means of the lifting members 32*c* and 33*c* provided on said transport rollers 32 and 33.

The developer 1 delivered to the developer transport section 111, as previously described, is fed through the supply aperture 115*a* provided at one end of the partition 115 into the developer supply section 114, and a part of the developer 1 lifted into the developer transport section 11, as previously described, is delivered from the opening section formed between the partition 115 and the descending partition 110*b* into the developer supply section 112.

In the developer supply section 114, on the other hand, the developer 1 transported in the opposite direction to that of the developer transport section 111 is returned to the developer transport section 111 through the return aperture 115*b* provided at the other end of the partition 115, such that the developer 1 circulates between the developer transport section 111 and the developer supply section 114. A part of the developer 1 lifted in the developer supply section 114 is supplied to the developing sleeve 18. The developer 1 supplied to the developing sleeve 18 is conducted to the image-carrying member 2 via the rotation of said developing sleeve 18, and the toner contained therein is supplied to the image-carrying member 2. A part of the lifted developer 1 is delivered through the open area formed between the partition 115 and the descending partition 110*b* into the developer transport section 11.

The result of development using the toner supplied to the image-carrying member 2 as previously described is that when toner density becomes low in the developer 1, fresh toner is resupplied from a toner bottle or the like (not shown in the illustrations) to the toner supply section 112 provided so as to be connected to the developer transport section upstream from the developer transport section 111 in the developer transport direction. This fresh resupplied toner is delivered through the toner supply section 112 to the developer transport section 111.

When fresh toner is resupplied to the developer transport section 111 as previously described, the fresh toner is mixed during transport with the developer in said developer transport section 111 via the previously mentioned mixing member 33. Thus, toner is resupplied during transport of the developer 1, and the developer 1 with increased toner density is lifted by the lifting member 33*c* such that a part of said developer 1 with increased toner density is fed into the developer supply section 114 through the opening formed between the previously mentioned partition 115 and descending partition 110*b*. On the other hand, the toner in the developer supply section 114 is used for development. The developer 1 having a reduced toner density is lifted by the lifting member 32*c* of the transport roller 32, such that a part of the developer 1 having a reduced toner density is delivered to the developer transport section 111 from the opening formed between the aforesaid partition 115 and descending partition 110*b*.

The developer 1 having an increased toner density via the resupplied toner and the developer 1 having a reduced toner density due to its use for development move between the developer transporting section 111 and the developer supply section 114 via the openings formed between the partition 115 and the descending partition 110*b*, such that the developer 1 having a high toner density due to the resupplied toner is mixed in the developer transport section 111, achieving sufficient dispersion during transport so as to achieve uniform toner density in the developer 1, and the resupplied toner is charged by said sufficient mixing in the developer 1.

In the developing device of the present embodiment, the transport rollers 32 and 33 in the developer supply section 114 and developer transport section 111 are arranged such that the lifting members 32*c* and 33*c* of said transport rollers 32 and 33 are not mutually confronting at a position opposite the partition 115. Accordingly, when part of the developer 1 lifted by the lifting members 32*c* and 33*c* is moved reciprocally between the developer supply section 114 and the developer transport section 111, there is no obstruction in the delivery of the developer 1 lifted by the respective lifting members 32*c* and 33*c*, such that said part of the developer 1 lifted by the lifting members 32*c* and 33*c* moves smoothly between the developer supply section 114 and the developer transport section 111.

When fresh toner is resupplied to the developer transport section 111 as previously described, said resupplied toner is immediately lifted by the lifting member 33*c* of the transport roller 33 provided in the developer transport section 111. Therefore, even though the toner in the developer 1 is delivered in an inadequately charged state from the developer transport section 111 through the opening formed between the partition 115 and descending Partition 110*b* to the developer supply section 114, said inadequately charged toner is not directly supplied to the lifting member 32*c* of the transport roller 32 in the developer supply section 114, such that said inadequately charged toner is not immediately supplied to the developing sleeve 18 via the lifting member 32*c* and is not used for development.

The developing devices of the previously described embodiments and the conventional developing devices as shown in FIGS. 1 and 2 are investigated for changes over time in toner density in the developer 1 in the developer transport section 111 as fresh toner is delivered from the toner supply section 112 to the developer transport section 111.

Figure 12:
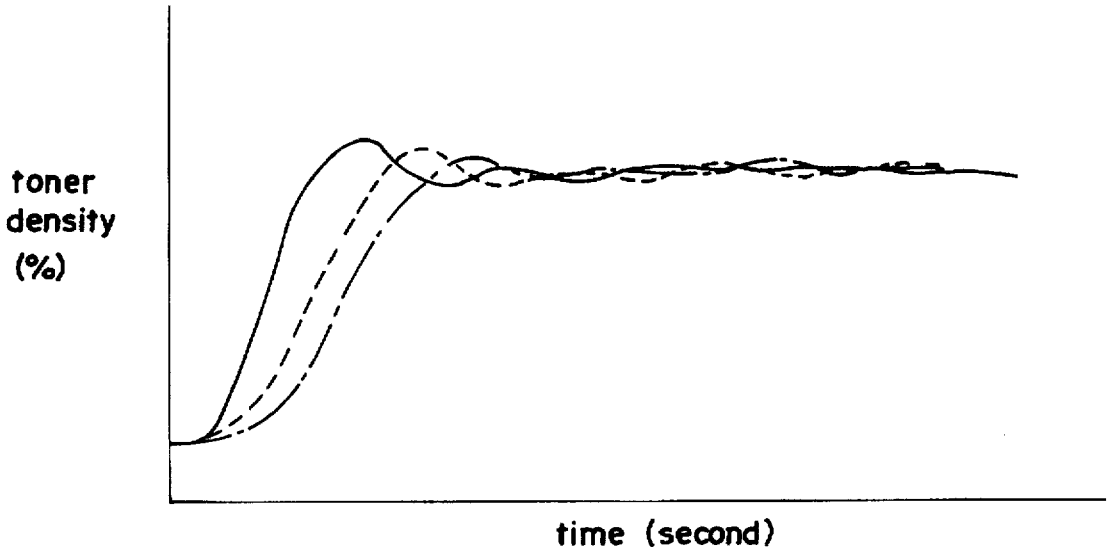
FIG. 12 is an illustration showing the results of an investigation of the change over time in toner density in the developer within the developer transport section as fresh toner is delivered from the toner resupply section to the developer transport section in the developing device of the third embodiment of the invention.
Figure 13:
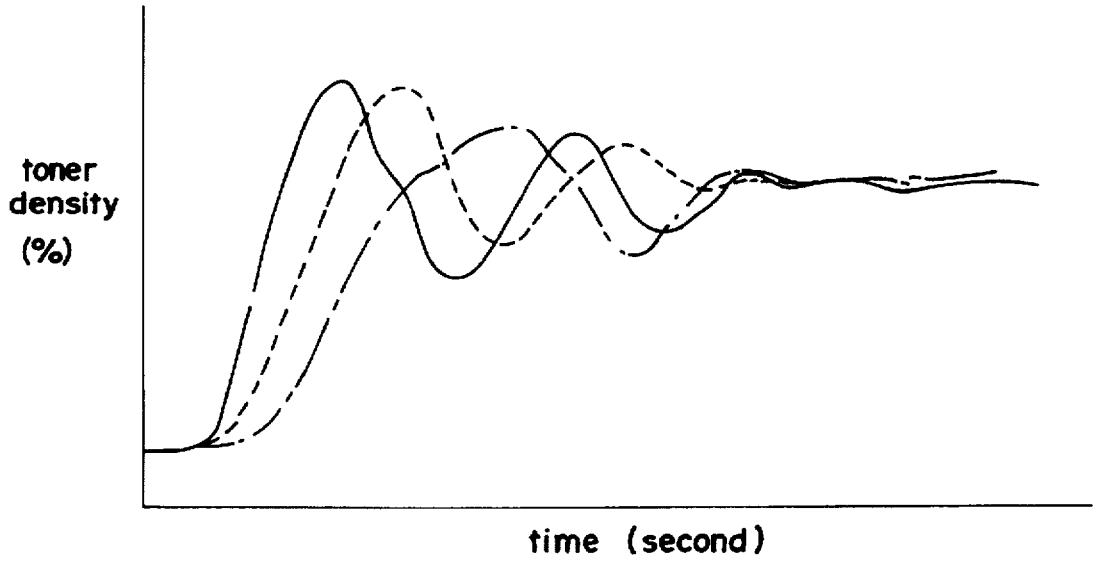
FIG. 13 is an illustration showing the results of an investigation of the change over time in toner density in the developer within the developer transport section as fresh toner is delivered from the toner resupply section to the developer transport section in the conventional developing device shown in FIGS. 1 and 2.

To investigate the change over time in toner density in the developer 1, toner density in the developer 1 was measured over time at three locations in the developer transport section 111 of the respective developing devices: a position near the return aperture 115*b* on the upstream side in the direction of transport of the developer 1, a position in the center of said developer transport section 111, and a position near the supply aperture 115*a* on the downstream side in the direction of transport of the developer 1. FIG. 12 shows the results using the developing device of the third embodiment wherein the solid line indicates the change over time in toner density at a position on the upstream side in the direction of transport of the developer 1, the dashed line indicates the change over time in toner density at a position in the central area, and the chain line indicates the change over time in toner density at a position on the downstream side in the direction of transport of the developer 1. FIG. 13 similarly shows the results for the results for a conventional developing device.

As can be clearly understood from the results shown in FIGS. 12 and 13, after the fresh toner is resupplied from the toner supply section 112 to the developer transport section 111 in the developing device of the third embodiment, the toner density in the developer 1 rapidly becomes uniform in the developer transport section 111. Conversely, in the conventional developing device shown in FIGS. 1 and 2, the toner density in the developer 1 in the developer transport section 111 does not become uniform until the developer 1 resupplied with the fresh toner has circulated between the developer transport section 111 and the developer supply section 114 several times, such that a relatively longer time is required for uniform dispersion of the resupplied toner in the developer 1.

Thus, when fresh toner is resupplied in the developing device of the third embodiment, there is only slight occurrence of localized increase in toner density in the developer 1 in the areas receiving the fresh toner, such that there is a reduced occurrence of nonuniform toner density in the developer 1 common to conventional developing devices. The fresh resupplied toner is rapidly dispersed in the developer 1, thereby quickly achieving uniform toner density in said developer 1 and adequately charging the resupplied toner via sufficient mixing with said developer 1.

Figure 14:
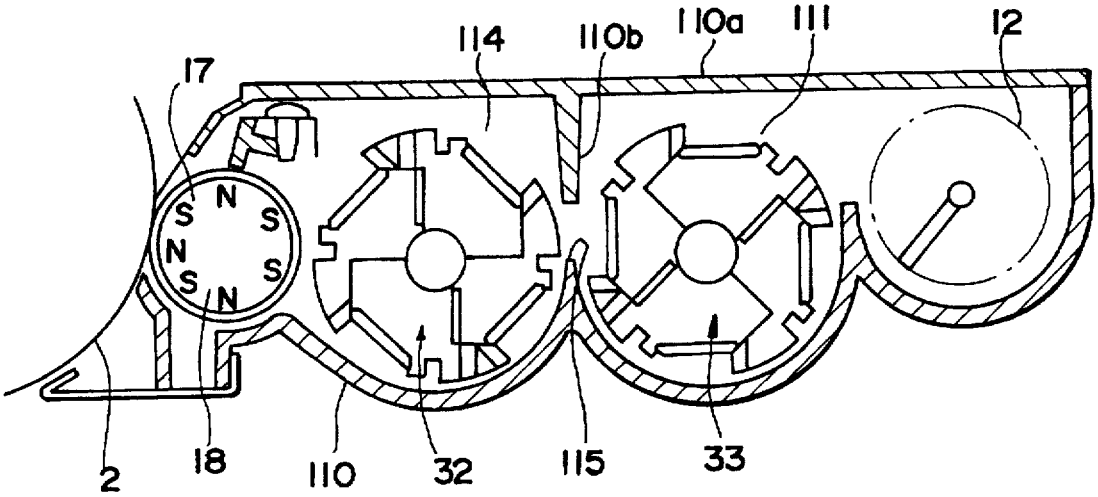
FIG. 14 is a brief section view showing the interior of the developing device of a fourth embodiment of the invention as viewed from the side.

Although, in the developing device of the third embodiment, the developer transport section 111 is provided so as to be connected to the toner supply section 112 for resupplying toner on the upstream side in the direction of transport of the developer 1, and the fresh toner fed from a toner bottle or the like is delivered through the toner supply section 112 to the developer transport section 111 on the upstream side in the direction of transport of said developer 1, it is to be noted that the toner supply section 112 is not limited to such an arrangement. Alternatively, as a fourth embodiment of the developing device shown in FIG. 14, the toner supply section 112 for supplying toner to the developer transport section 111 may be provided on the opposite side relative to the developer supply section 114 along the length-wise direction of the developer transport section 111, such that toner is resupplied uniformly on a line from the toner supply section 112 to the developer transport section 111.

Even when the toner is supplied in a uniform line from the toner supply section 112 to the developer transport section 111, the developer 1 having a high toner density due to resupplied toner and the developer 1 having a low toner density due to the use of said toner for development move between the developer transport section 111 and the developer supply section 114 through the opening formed between the partition 116 and the descending partition 110*b*, whereby the resupplied toner is adequately dispersed in the developer 1 via mixing therewith which also adequately charges the resupplied toner.

A fifth embodiment of the developing device is described hereinafter.

Figure 15:
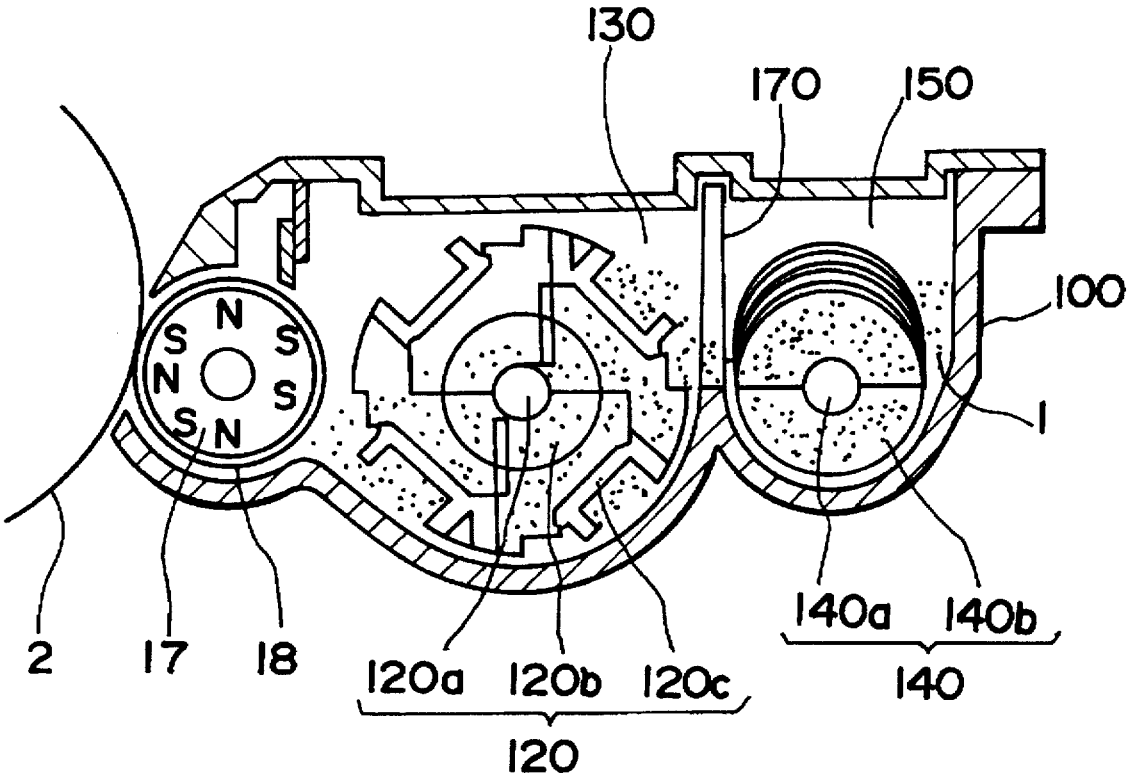
FIG. 15 is a brief section view showing the interior of the developing device of a fifth embodiment of the invention as viewed from the side.
Figure 16:
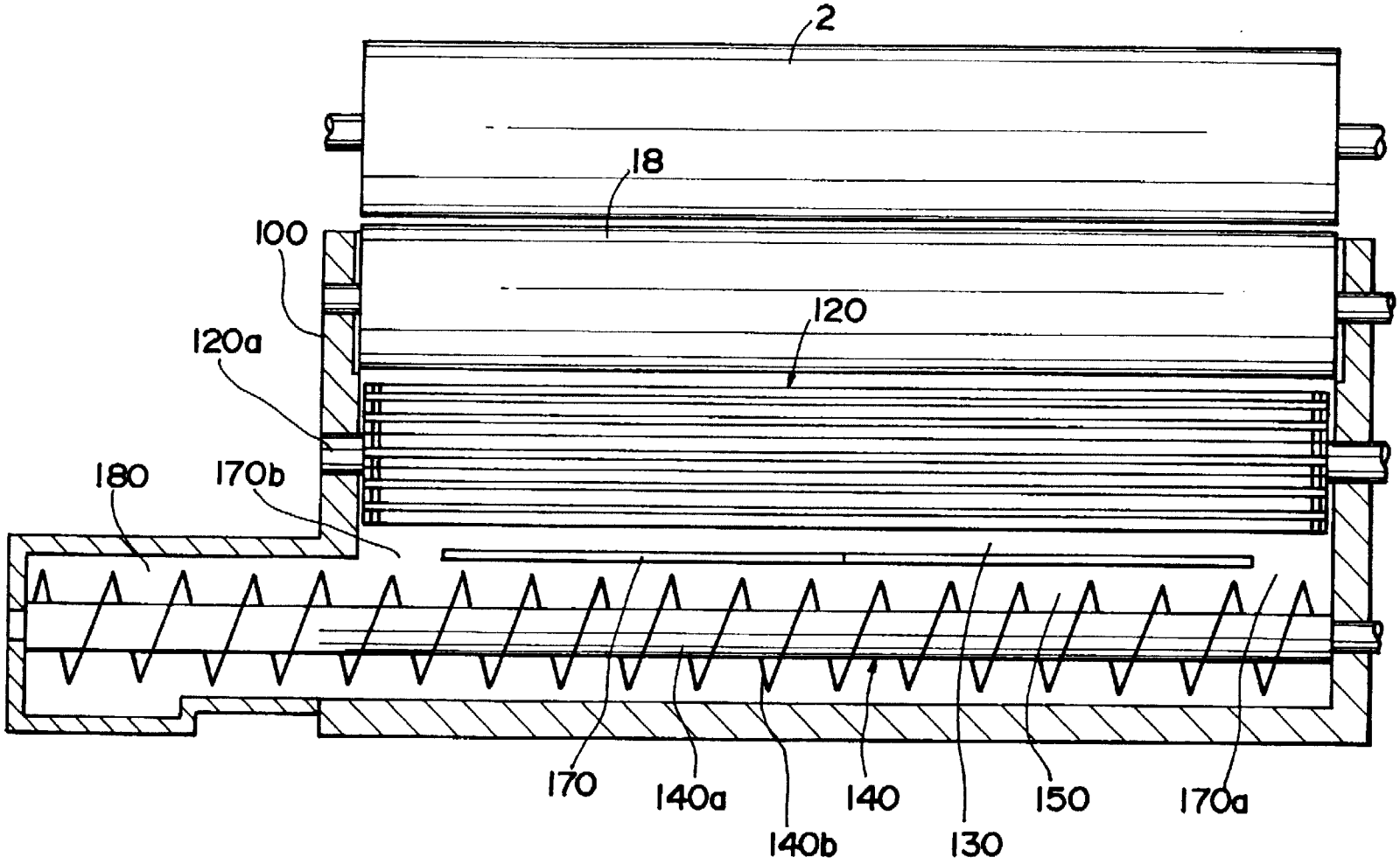
FIG. 16 is a brief section view showing the interior of the developing device of FIG. 15 as viewed from the top.
Figure 17:
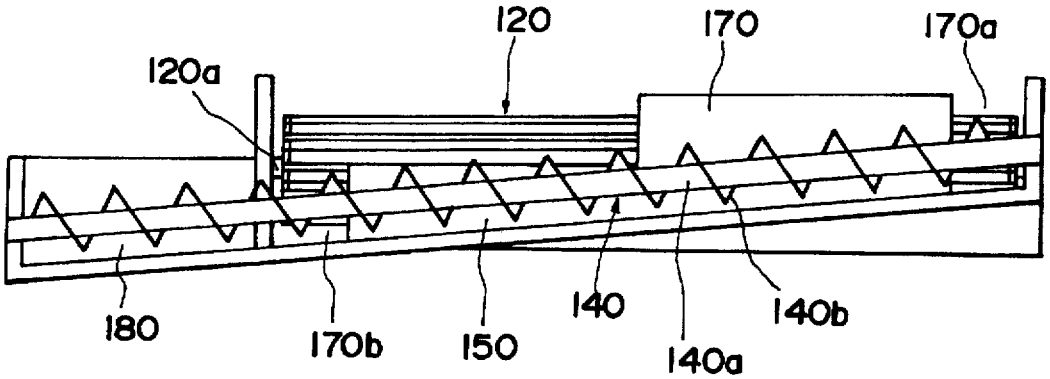
FIG. 17 is an illustration showing the state of the partition provided within the interior of the developing device of FIG. 15.

In the developing device of the fifth embodiment shown in FIGS. 15–17, a developing sleeve 18 provided with an internal magnet roller 17 is rotatably provided at the open section of the housing 100 so as to be opposite the image-carrying member 2. A partition 170 is provided along the axial direction of the developing sleeve 18 within the housing 100. The partition 170 separates the developer supply section 130 for transporting the developer 1 along the axial direction of the developing sleeve 18 within the housing 100 so as to supply said developer 1 to the developing sleeve 18, and the developer transport section 150 for mixing and transporting the developer 1 in the reverse direction relative to the developer supply section 130.

The developer supply section 130 is horizontally disposed, and within said developer supply section 130 is provided a first transport roller 120 having arranged on the exterior of a rotating shaft 120*a* a transport blade 120*b* and a lifting member 120*c* for lifting the developer 1. When the first transport roller 120 is rotated, the developer 1 within the developer supply section 130 is transported along the axial direction of the developing sleeve 18 so as to supply a part of said developer 1 to said developing sleeve 18. On the other hand, the aforesaid developer transport section 150 is arranged so as to incline upwardly from the upstream side to the downstream side in the direction of transport of the developer 1. Within said developer transport section 150 is provided a second transport roller 140 having a transport blade 140*b* of uniform spiral configuration on the exterior of a rotating shaft 140*a*. When the aforesaid transport roller 140 is rotated, the developer 1 within the developer transport section 150 is mixed and transported in the opposite direction relative to the developer supply section 130.

A toner supply section 180 for supplying toner to the developer 1 on the upstream side relative to the developer transport section 150, and is arranged so as to be connected to said developer transport section 150. Fresh toner resupplied from the toner bottle or the like (not illustrated) is delivered to the developer transport section 150 through the aforesaid toner supply section 180.

On the other hand, a supply aperture 170*a* for supplying developer 1 from the developer transport section 150 to the developer supply section 130 is provided at one end of the partition 170 which separates the developer supply section 130 and the developer transport section 150 within the housing 100. The other end of said partition 170 is provided with return aperture 170*b* for returning the developer 1 from the developer supply section 130 to the developer transport section 150.

In the developing device of the fifth embodiment shown in FIGS. 15 and 17, the height of the partition 170 on the downstream side in the direction of developer transport in the developer supply section 130, i.e., from the return aperture 170*b* side to the center area of the developer supply section 130, is set so as to be lower and roughly equal to the height at the axial center position of the rotating shaft 120*a* of the first transport roller 120 provided in said developer supply section 130. That is, the height difference Δh between the height f the partition 170 and the axial center position of the rotating shaft 120*a* of the first transport roller 120 is set at zero [0].

In the developing device of the fifth embodiment, when toner is supplied to the electrostatic latent image formed on the surface of the image-carrying member for development, the first and second transport rollers 120 and 140 provided in the developer supply section 130 and developer transport section 150 are rotated via their respective rotating shafts 120*a* and 140*a*, such that developer 1 is transported in the opposite direction in the developer transport section 150 and developer supply section 130 via the transport blades 120*b* and 140*b* provided on the aforesaid transport rollers 120 and 140.

The developer 1 is transported in the developer transport section 150 by the rotating second transport roller 140, and is delivered to the developer supply section 130 through the supply aperture 170*a* provided at one end of the partition 170. On the other hand, in the developer supply section 130 which has thus received developer 1, said developer 1 is transported in the reverse direction relative to the developer transport section 150 via the first transport roller 120, and the developer 1 is lifted by the lifting member 120*c* provided on said first transport roller 120, such that a part of the developer 1 is supplied to the developing sleeve 18 provided with an internal magnet roller 17. The supplied developer 1 is conducted to the image-carrying member 2 via the aforesaid developing sleeve 18, and development is accomplished by supplying the toner contained in said developer 1 to the image-carrying member 2.

After the toner is supplied to the image-carrying member 2 as described above, the developer 1 is transported in the reverse direction relative to the developer transport section 150 together with the other developer 1 in the developer supply section 130, and a part of this developer 1 passes over the partition 170 at the region of said partition 170 having a lower height so as to be delivered into the developer transport section 150. At the same time, the transported developer 1 passes through the return aperture 170*b* provided at the other end of the partition 170 and is returned to the developer transport section 150, whereby said developer 1 is circulated between the developer transport section 150 and the developer supply section 150.

Regarding development by supplying toner from the developer 1 to the image-carrying member 2, when the toner density in the developer 1 is reduced, toner is supplied to the developer transport section 150 through the toner supply section 180 provided upstream from the developer transport section 150 in the direction of developer transport, said toner passing through the return aperture 170*b* together with the developer 1 being returned to the developer transport section 150. The toner and developer i are mixed during transport via the second transport roller 140.

When the fresh toner is resupplied to the developer transport section 150 from the toner supply section 180, the toner density increases in the developer 1 receiving the resupplied toner. In the developing device of the fifth embodiment, a suitable amount of the developer 1 having a reduced toner density due to development passes over the partition 170 at the region having a lower height, and is conducted from the developer supply section 130 to the developer transport section 150. The aforesaid developer 1 having a reduced toner density is mixed with the aforesaid developer 1 having an increased toner density so as to achieve a suitable toner density. The toner contained in the developer 1 is adequately charged as this developer 1 is mixed by the second transport roller 140 as it is conducted to the supply aperture 170*a* provided at one end of the partition 170.

The developer 1 containing the adequately charged toner passes through the supply aperture 170*a* and is delivered from the developer transport section 150 to the developer supply section 130, and the developer 1 in the developer supply section 130 is used for development.

When the developing device of the fifth embodiment was used in 200,000 image formation processes, excellent image were uniformly produced without background fogging of the images, toner dispersion, nonuniform charging, or irregular image density in the formed images.

Figure 3:
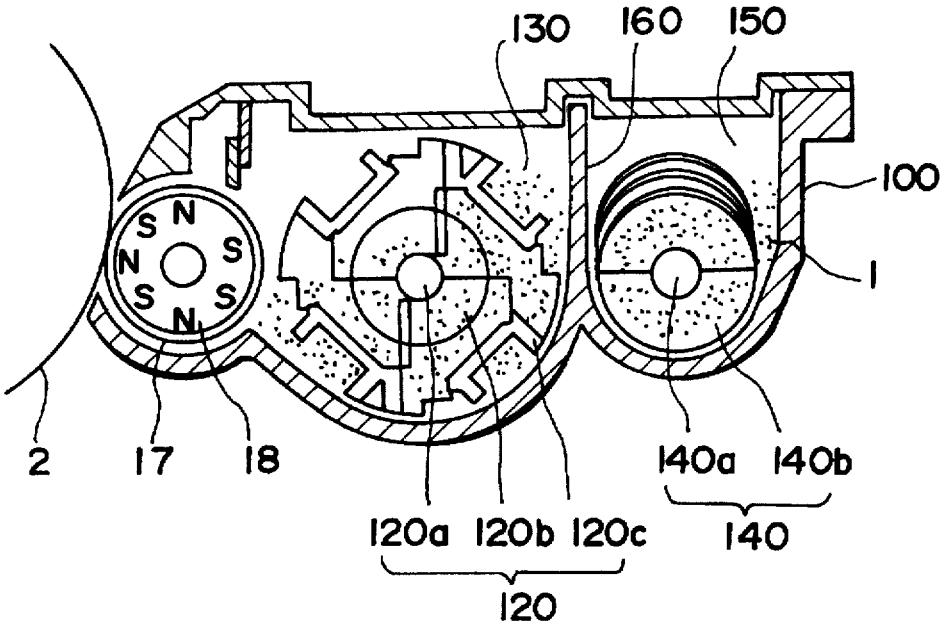
FIG.3 Prior Art
FIG. 3 is a brief section view showing the interior of another conventional developing device viewed from the side.
Figure 5:
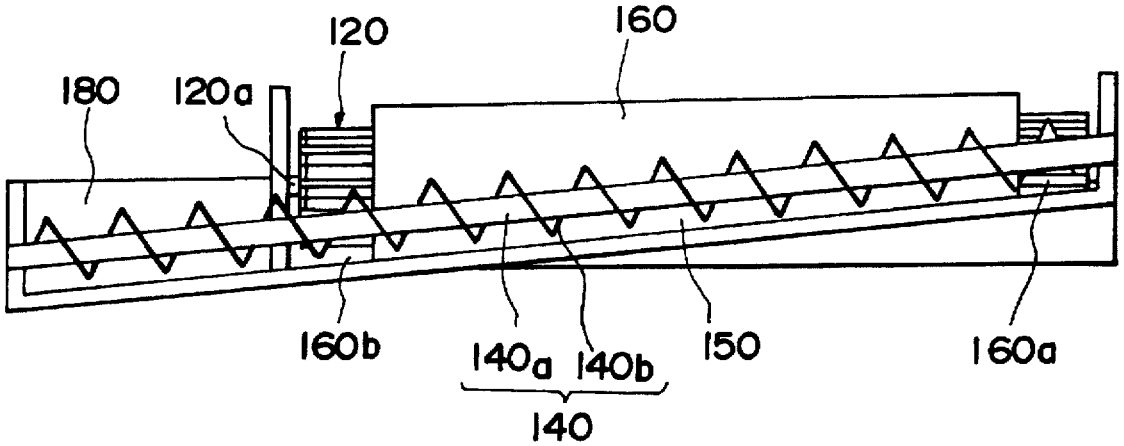
FIG.5 Prior Art
FIG. 5 is a simple illustration showing the condition of the partition provided in the interior of the developing device of FIG. 3.
Figure 4:
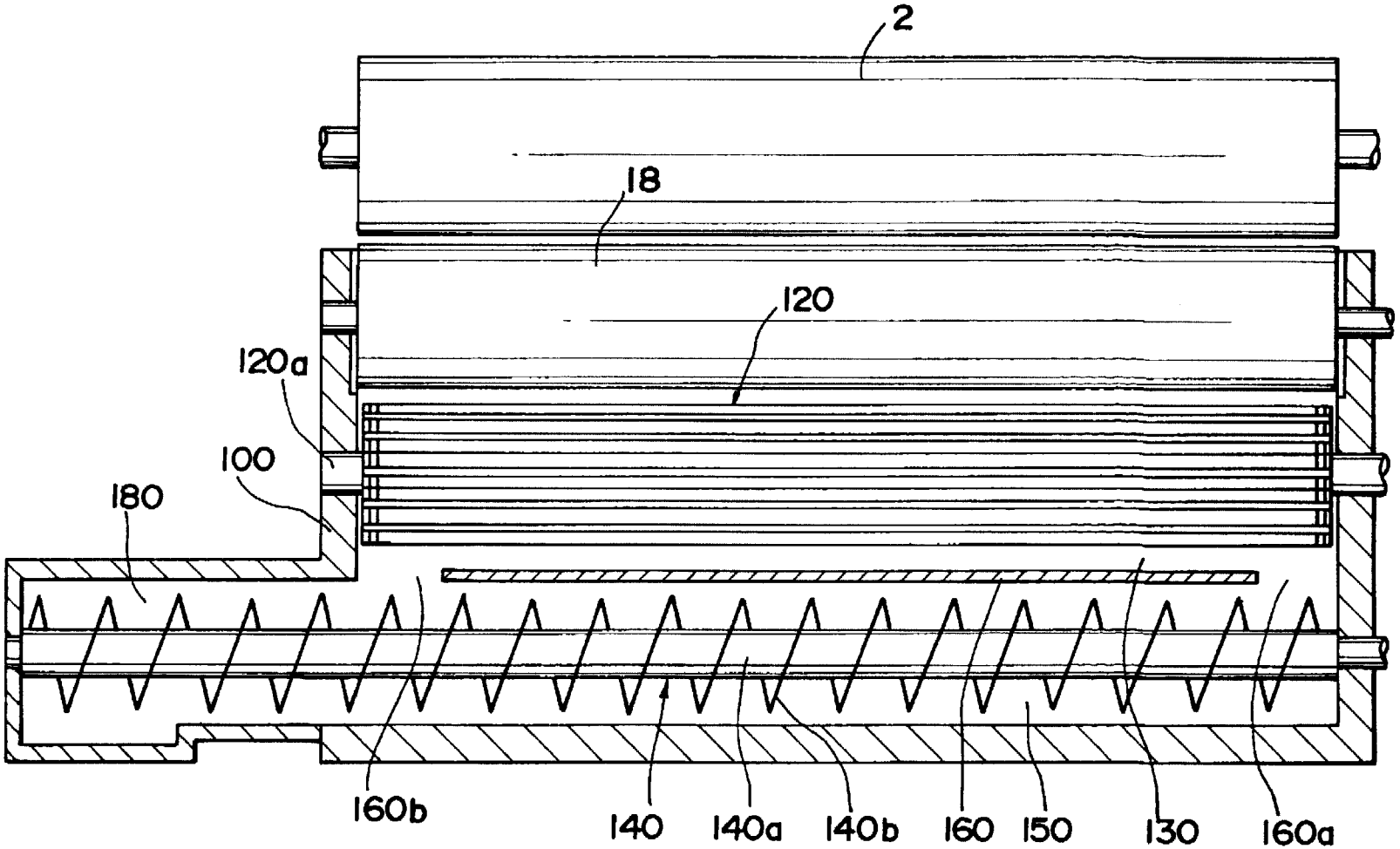
FIG. 4 Prior Art
FIG. 4 is a brief section view showing the interior of the developing device of FIG. 3 as viewed from the top.
Figure 18:
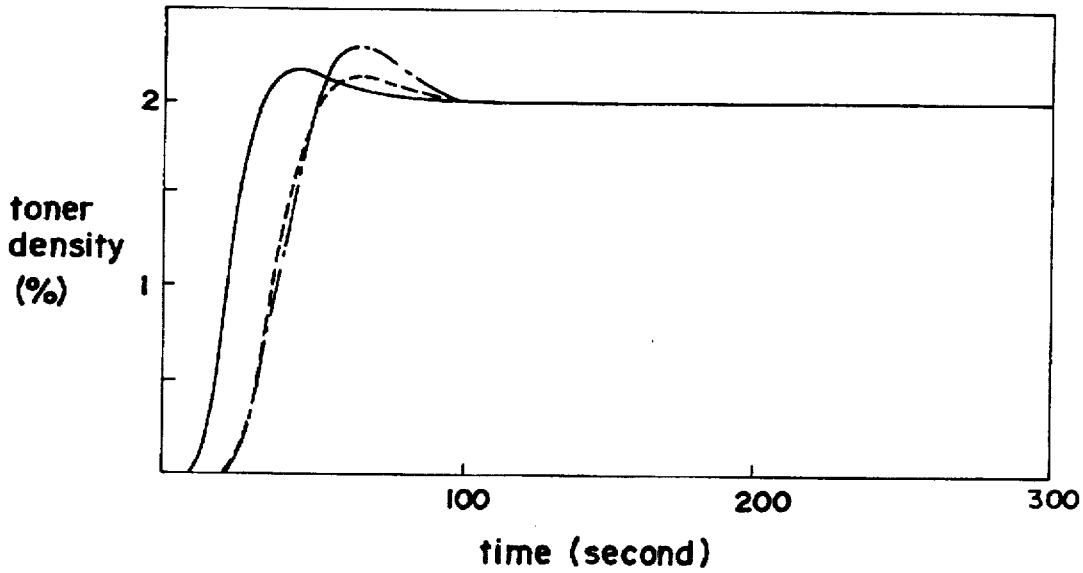
FIG. 18 is an illustration showing the results of an investigation of the change over time in toner density in the developer within the developer transport section as fresh toner is delivered from the toner resupply section to the developer transport section in the developing device of the fifth embodiment of the invention.
Figure 19:
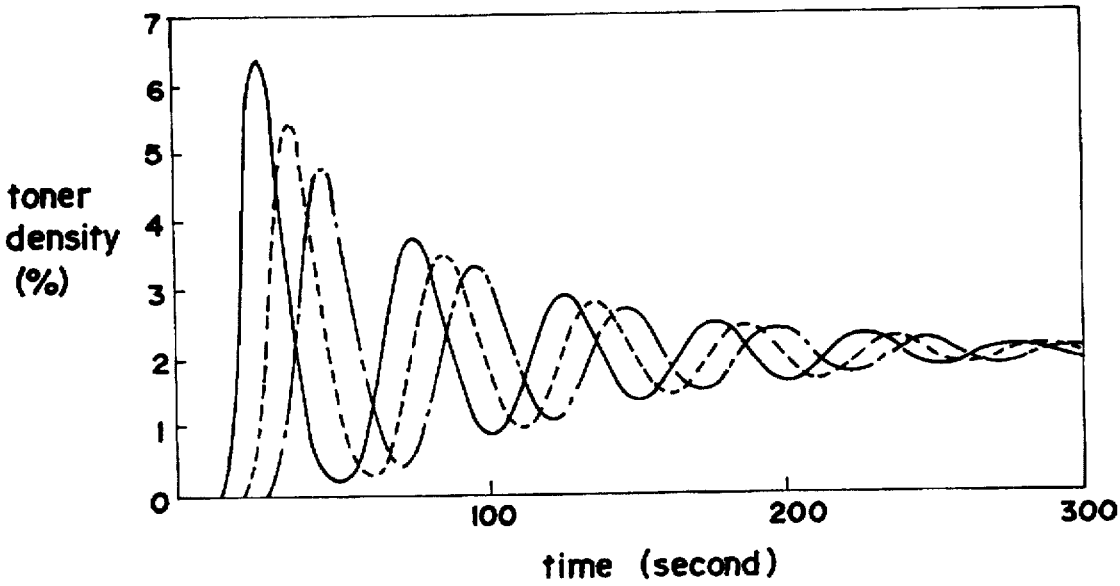
FIG. 19 is an illustration showing the results of an investigation of the change over time in toner density in the developer within the developer transport section as fresh toner is delivered from the toner resupply section to the developer transport section in the conventional developing device shown in FIGS. 3 and 4.

The developing device of the fifth embodiment and the conventional developing device shown in FIGS. 3–5 were used to once supply 10 g of toner per 500 g of developer from the toner supply section 180 to the developer transport section 150. The change in toner density in the developer 1 was measured at three locations: a position upstream from the developer transport section 150 in the developer transport direction, a position in the center region, and a position at the downstream side. FIG. 18 shows the results of the measurement using the developing device of the fifth embodiment. FIG. 19 shows the measurement results using the conventional developing device of FIGS. 3–5. In the drawings, the solid line indicates the change in toner density at the upstream position, the dashed line indicates the change in toner density at the center position, and the chain line indicates the change in toner density at the downstream position.

As can be clearly understood from these measurement results, the one-time supply of toner to the developer transport section 150 did not produce an abnormal local increase in toner density using the developing device of the fifth embodiment, and toner density in the developer 1 was rapidly stabilized at all three positions upstream, center and downstream in the developer transport section 150 in the direction of developer transport. In contrast, using the conventional developing device of FIGS. 3–5, it was found that toner density was abnormally locally increased at the locations receiving the resupplied toner, and the developer 1 did not achieve a stable toner density until the developer 1 having said high toner density was circulated between the developer transport section 150 and developer supply section 130. A long time was required to achieve stable toner density.

In the developing device of the fifth embodiment, the resupplied toner is adequately charged via mixing with the developer 1 by means of the second transport roller 140 in the developer transport section 150, and rapidly stabilizing the density of the toner in the developer 1. With the resupplied toner in the aforesaid adequately charged state, the developer 1 passes through the supply aperture 170*a* so as to be delivered from the developer transport section 150 to the developer supply section 130 to produce excellent images with stability during development. In contrast, in the conventional developing device of FIGS. 3–5, it is clear the resupplied toner is not adequately mixed with the developer 1 because the toner density is markedly increased in the developer 1 which has received the resupplied toner. Accordingly, the developer 1 passes through the supply aperture 170*a* with the resupplied toner in an inadequately charged state, and is delivered from the developer transport section 150 to the developer supply section 130 for use in development. The produced developed images contained background fogging, toner dispersion, irregular charging, and nonuniform density in the formed images.

Figure 20:
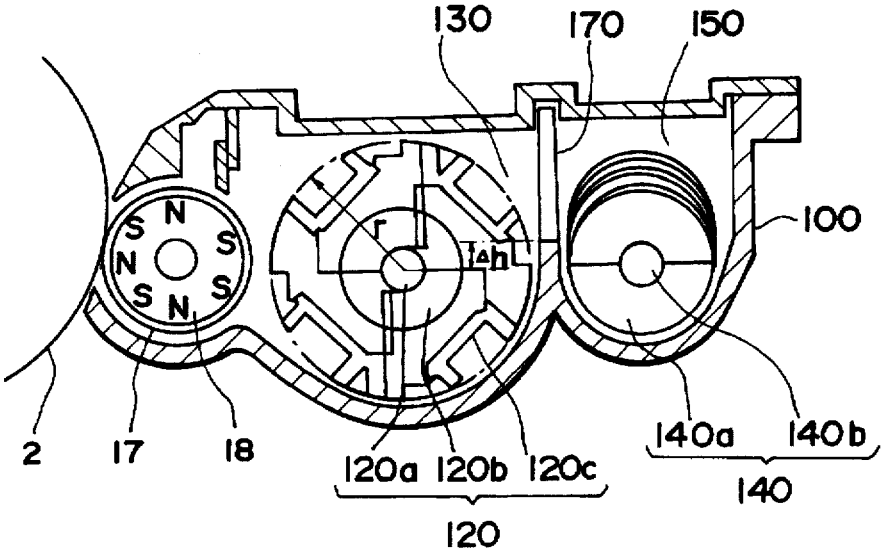
FIG. 20 is a brief section view showing the states of change in the height of the partition at its lower portion within the developing device.
Figure 21:
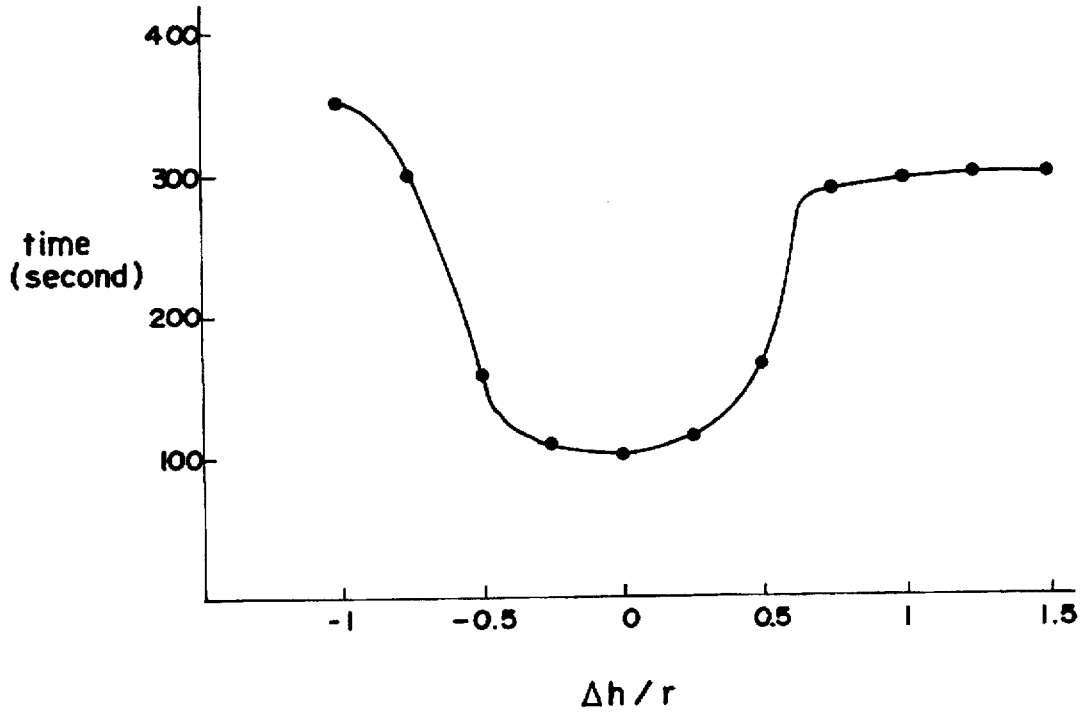
FIG. 21 is an illustration showing the results of measurements of toner density in the developer within the developer transport section until said toner density becomes stabilized as fresh toner is delivered from the toner resupply section to the developer transport section in conjunction with changes in the height of the partition at its lower portion within the developing device of the fifth embodiment of the invention.

The influence of the height difference Δh between the height of the partition 170 and the axial center position of the rotating shaft 120*a* of the first transport roller 120 in the developing device of the fifth embodiment was investigated by changing the height of the partition 170 at its lowest area. As shown in FIG. 20, the difference Δh in the height of the partition 170 at its lowest area and the height of the axial center position of the rotating shaft 120*a* of the first transport roller 120 changes. The ratio Δh/r of the height differential Δh and the radius r of the first transport roller 120 changes within a range of −1–1.5. As previously described, 10 g of toner per 500 g of developer was resupplied once from the toner supply section 180 to the developer transport section 150, and the time was measured until the toner density in the developer became stabilized. The results of these measurements is shown in FIG. 21. The value of the ratio Δh/r is negative when the height of the lowest area of the partition 170 is lower than the axial center position of the rotating shaft 120*a* of the first transport roller 120, and is positive when said height of the lowest area of partition 170 is higher than the axial center position of said rotating shaft 120*a* of the first transport roller 102.

When the value of the aforesaid value of Δh/r is within the range of ±0.5, i.e., when $|\Delta h| \leqq 0.5r$, the toner density in the developer 1 is rapidly stabilized. When the value of Δh/r is greater than +0.5, a lesser amount of developer 1 passes over the partition 170 from the developer supply section 120 and is delivered into the developer transport section 150, such that a longer time is required until the toner density in said developer 1 becomes stabilized. Furthermore, when the value of Δh/r is less than −0.5, a larger amount of developer 1 passes over the partition 170 from the developer supply section 130 and is delivered into the developer transport section 150, such that inadequate transport of developer 1 and mixing of the developer and toner via the second transport roller 140 results. In such an instance, a longer time is also required until the toner density in said developer 1 becomes stabilized. Thus, it is preferable that the aforesaid height difference Δh be set so as to satisfy the relationship $|\Delta h| \leqq 0.5r$.

Figure 22:
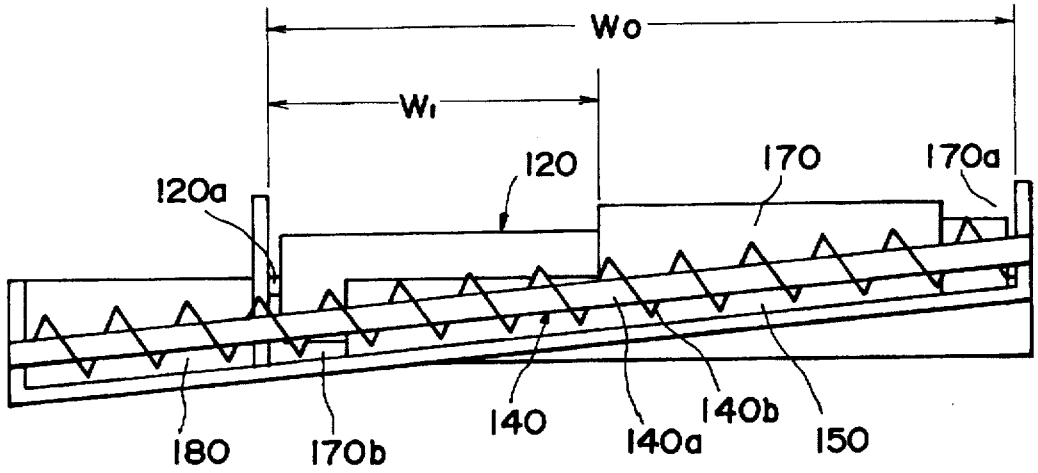
FIG. 22 is a brief section view showing the state of change in the length of the lower portion of the partition in the developing device of the fifth embodiment of the invention.

Also examined was the desirable range within which the lower area of the partition 160 on the downstream side of the developer supply section 130 in the developer transport direction when the height of the partition 170 is lower so as to be roughly equal to the height of the axial center position of the rotating shaft 120*a* of the first transport roller 120 as in the developing device of the fifth embodiment. That is, when the length of the section of lower height of the partition 170 is varied, the ratio (W1/W0) of the length W1 of said section of lower height of the partition 170 and the total length W0 of the developer supply section 130 also changes, as shown in FIG. 22. The time required to achieve stable toner density in the developer 1 was measured when once supplying 10 g of toner from the toner supply section 180 per 500 g of developer 1 to the developer transport section 150. The results of these measurements are shown in FIG. 23.

Figure 23:
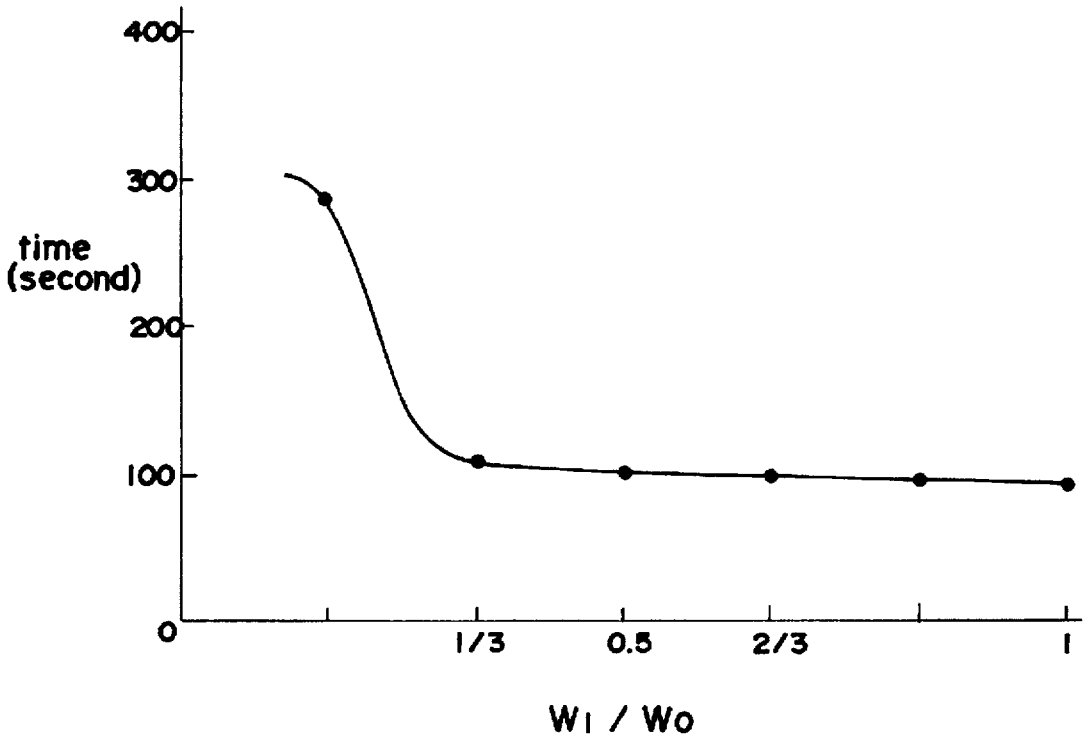
FIG. 23 is an illustration showing the results of measurements of toner density in the developer within the developer transport section until said toner density becomes stabilized as fresh toner is delivered from the toner resupply section to the developer transport section in conjunction with changes in the height of the partition at its lower portion within the developing device of the fifth embodiment of the invention.
Figure 24:
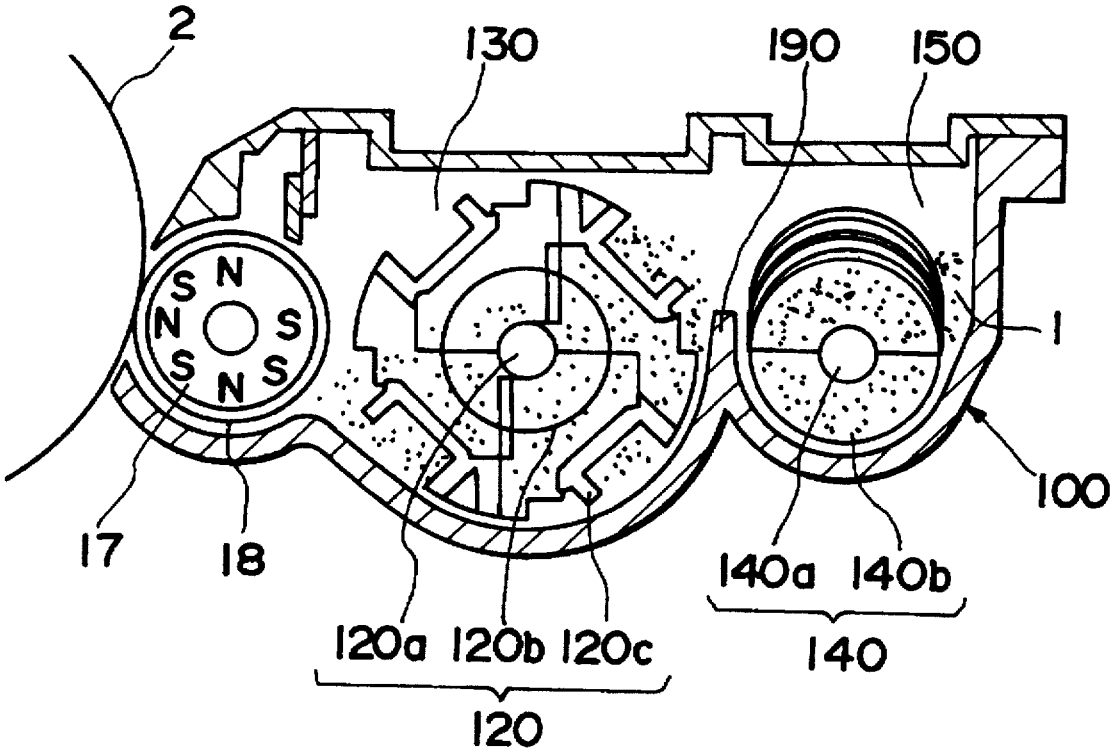
FIG. 24 is a brief section view showing the interior of the developing device of a sixth embodiment of the present invention as viewed from the side.
Figure 25:
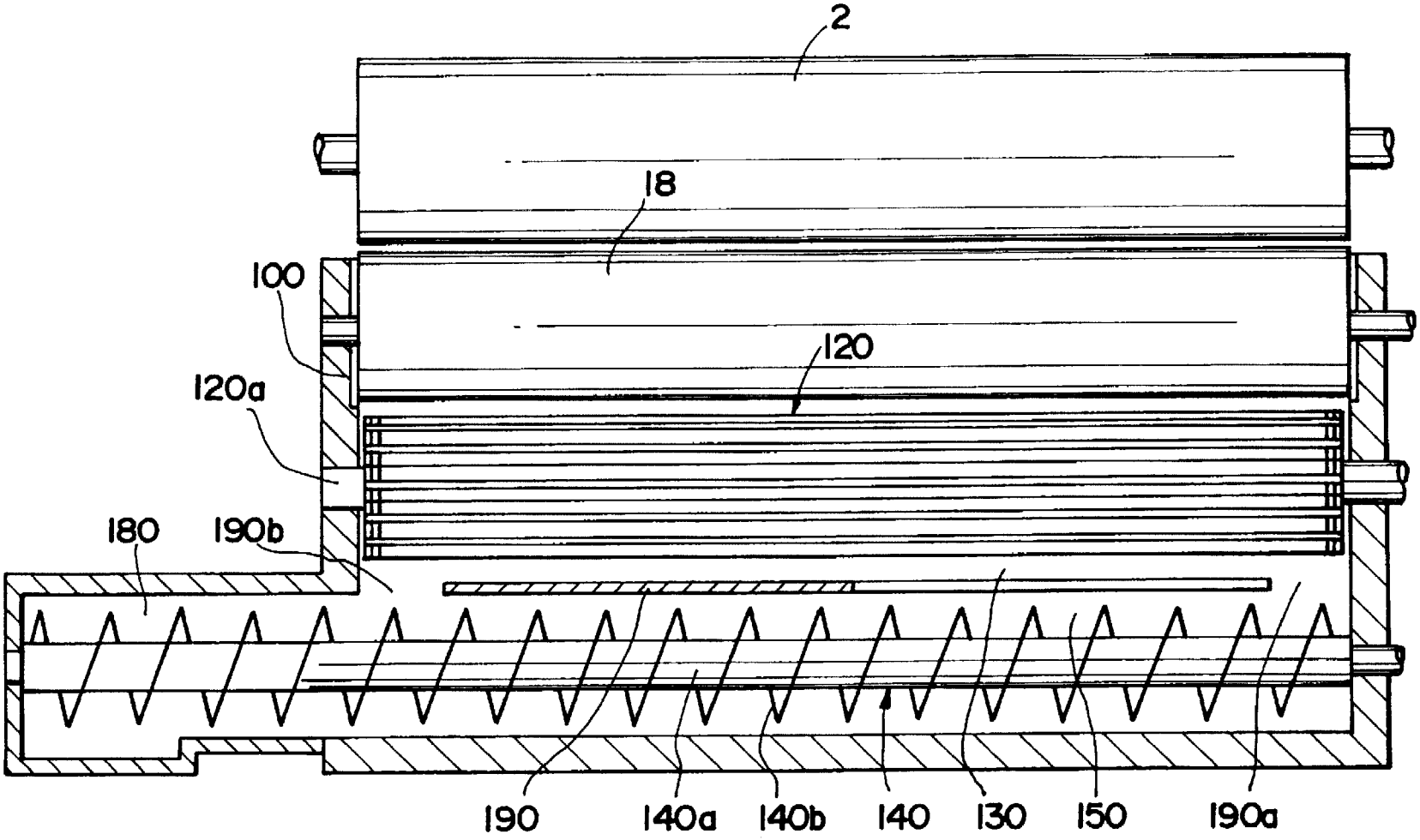
FIG. 25 is a brief section view showing the developing device of FIG. 24 as viewed from the top.
Figure 26:
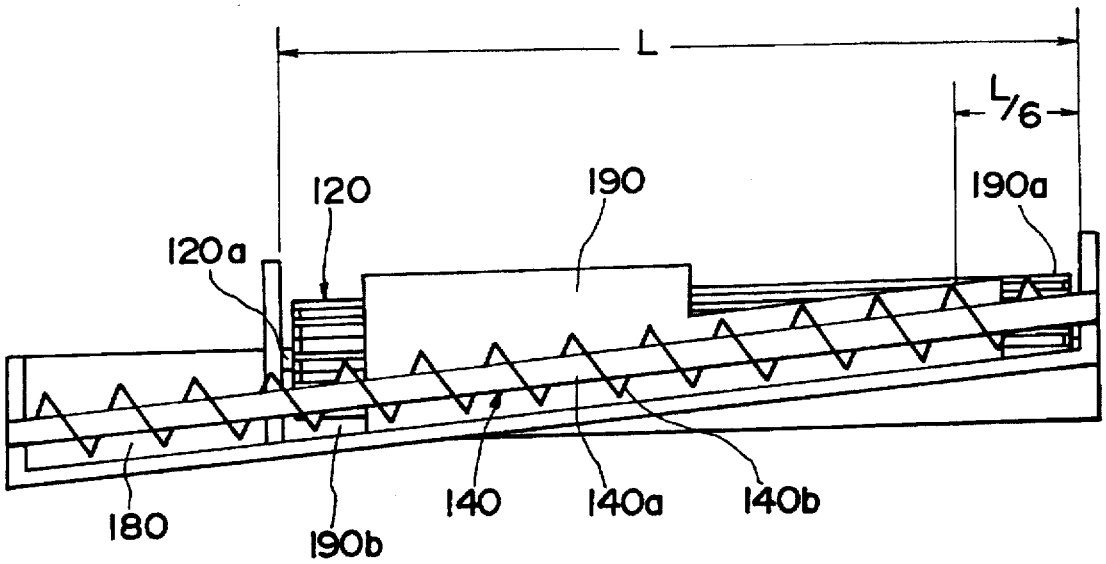
FIG. 26 is a brief section view showing the state of the partition within the developing device of FIG. 24.

The measurement results shown in FIG. 23 show that if the ratio (W1/W0) of the length W1 of the section of lower height of the partition 170 from the end on the downstream side of the developer supply section 130 in the developer transport direction and the total length W0 of the developer supply section 130 is equal to or greater than ⅓, stability of the toner density in the developer 1 is rapidly achieved. However, if the ratio (W1/W0) is less than ⅓, the amount of developer 1 that passes over the partition 170 from the developer supply section 130 to the developer transport section 150 is reduced, and a longer time is required to achieve stability of the toner density in the developer 1. Therefore, it is preferable that the height of the partition 170 be lowered to a position at least +e.fra 13+ee of the developer supply section 130 on the downstream side.

A sixth embodiment of the developing device of the present invention is described hereinafter.

The construction of the developing device of the sixth embodiment shown in FIGS. 24–28 is identical to that of the fifth embodiment with the exception of the partition 190, and a complete description is therefore omitted.

In the developing device of the sixth embodiment, the partition 190 is notched on the top from the supply aperture 190*a* side to the center of the partition 190 downstream from the second transport section 150, and the height of the partition 190 in said notched section is lower. The developer 1 passes over the partition 190 at the aforesaid section having a lower height so as to be delivered from the second transport section 150 to the first transport section 130.

In the developing device of the sixth embodiment, when the length of the second transport section 150 and the first transport section 130 through which circulates the developer 1 is designated L, the relationship between the flow amount Q1 of the developer per unit time delivered from the second transport section 150 to the first transport section 130 at the section L/6 from the end of the partition provided with the supply aperture 190*a*, and the flow amount Q2 of the developer per unit time delivered from the second transport section to the first transport section at the section other than L/6 is expressed as Q2/Q1=1.

When achieving development by supplying toner to an electrostatic latent image formed on the image-carrying member 2 in the developing device of the sixth embodiment, the first and second transport rollers 120 and 140 provided in the first transport section 130 and second transport section 150 are rotated via their respective rotating shafts 120*a* and 140*a* so as to mix the developer 1 via the transport blades 120*b* and 140*b* provided on said transport rollers 120 and 140 while transporting the developer 1 in the opposite direction relative to the second transport section 150 and first transport section 130.

When the second transport roller 140 is rotated, the developer 1 which is transported and mixed within the second transport section 150 passes over the partition 190 at its lowest region and is delivered into the first transport section 130, and said developer 1 is also passes through the aforesaid supply aperture 190*a* provided at one end of the partition 190 so as to be delivered into the first transport section 130.

In the first transport section 130 to which the developer 1 has been delivered, said developer 1 is transported in the opposite direction to that of the second transport section 150 via the first transport roller 120, and said developer 1 is lifted by the lifting member 120*c* provided on the first transport roller 120. A part of this developer 1 is supplied to the developing sleeve 18 provided with an internal magnet roller 17, and this supplied developer 1 is conducted to the image-carrying member 2 via the developing sleeve 18, whereupon the toner contained in the developer 1 is supplied to the image-carrying member 2 and development is accomplished.

After the toner is thus supplied to the image-carrying member, this developer 1 is transported in the opposite direction relative to the second transport section 150 together with the other developer 1 within the first transport section 130, said combined developer 1 passes through the return aperture 190*b* provided at the other end of the partition 190, and is returned to the second transport section 150.

When the toner density in the developer a is reduced below a predetermined level as a result of the aforesaid toner in the developer 1 being supplied to the image-carrying member 2 to accomplish development, toner is resupplied to the second transport section 150 through toner supply section 180 provided at the upstream side of the second transport section 150 in the direction of developer transport. This toner is mixed and transported together with the developer 1 returned to the second transport section 150 through the return aperture 190*b* via the second transport roller 140.

When the fresh toner is resupplied from the toner supply section 180 to the second transport section 150, the toner density becomes high in the developer 1 which receives the resupplied toner. Thus, when the developer 1 with the high toner density is mixed and transported by the second transport roller 140 and arrives at the low section of the partition 190, said developer 1 passes over said low section of the partition 190 and is gradually delivered into the first transport section 130. At the same time, the remaining developer 1 with the high toner density passes through the supply aperture 190*a* and is delivered into the first transport section 130, and said developer 1 with the high toner density is mixed and dispersed with the developer 1 contained in the first transport section 130. This dispersion rapidly stabilizes toner density in the developer 1, and the fresh resupplied toner is suitably charged via adequate mixing with the developer 1.

In the developing device of the sixth embodiment, when the fresh toner is resupplied from the toner supply section 180, the fresh resupplied toner is rapidly and suitably charged by the developer 1 and is used for development. The obtained developed images were excellent and produced with stability without background fogging, toner scattering due to irregular charging, or nonuniform image density in the developed images.

The movement of the toner when said toner is resupplied from the toner supply section 180 is investigated hereinafter using the developing device of the sixth embodiment and the conventional developing device shown in FIGS. 3–5.

Figure 27:
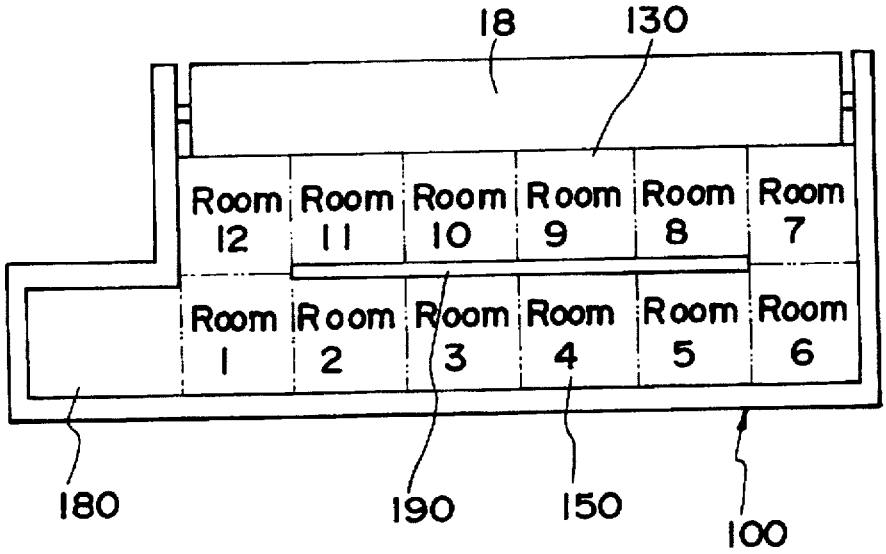
FIG. 27 is an illustration showing the second transport section and the first transport section subdivided in 1–12 equal-sized compartments to investigate the movement of the resupplied toner in a conventional developing device shown in FIGS. 3–5 and the developing device of the sixth embodiment of the present invention.

In order to investigate the movement of the resupplied toner in the aforesaid developing devices, the second transport section 150 and the first transport section 130 were respectively subdivided into six compartments, as shown in FIG. 27. The compartments are sequentially designated rooms 1 6 from the upstream side to the downstream side in the direction of developer transport in the second transport section 150, and designated rooms 7–12 from the upstream side to the downstream side in the direction of developer transport in the first transport section 130. The amount of flow of the developer per unit time in each of the rooms 1–12 and the toner density in the developer were averaged. The toner density in the developer was set at 5% by weight with 30 g of developer in each compartment. The amount of toner in each compartment was 1.5 g.

In each of the aforesaid developing devices, 5 g of toner was first resupplied to room 1 of the second transport section 150. Thereafter, the first and second transport rollers 120 and 140 provided in the second transport section 150 and first transport section 130 each are rotated for two seconds to mix and transport the developer contained in each developing device. The change in the amount of toner in each compartment was measured after toner resupply began and the developer 1 had been transported for two seconds. Rooms 2–12 also resupplied 5 g of toner in the same manner as room 1, and the change in the amount of toner in each compartment was measured after toner resupply began and the developer had been transported for two seconds to determine the movement of said toner.

These measurements indicate that in the conventional developing device shown in FIGS. 3–5, the toner is resupplied similarly in all rooms 1–12. At the start of supplying the toner only 5 g of toner is supplied to the compartment receiving said toner, but 3 g of toner is moved from the compartment initially receiving said toner to the next compartment on the downstream side after two seconds of mixing/transporting the developer 1.

In the developing device of the sixth embodiment, however, when the toner is supplied to room 4 in the second transport section 150, at the start of supplying toner only 5 g of toner is supplied to room 4, and thereafter, when the developer 1 has been mixed/transported for two seconds, 2.5 g of toner is moved from room 4 to the next room 5 on the downstream side. On the other hand, 1.5 g of toner passes over the low part of the partition 190, and is moved into room 9 of the first transport section 130 disposed opposite room 4. When toner is supplied to room 5, 2.5 g of toner moves from room 5 to the next room 6 on the downstream side after two seconds of mixing/transport of the developer 1, and 1.5 g of toner passes over the low part of the partition 190 and moves into room 8 of the first transport section 130 disposed opposite room 5.

In the developing device wherein the first transport section 130 and the second transport section 150 are separated by the partition 190, the shape of said partition 190 was modified, as shown in FIGS. 28–34, so as to change the amount of developer that passes over the partition 190 from the second transport section 150 to the first transport section 130. The ratio (Q2/Q1) is hereinafter modified between the amount of flow Q1 of the developer per unit time delivered from the second transport section 150 to the first transport section 130 at the section L/8 from the end of the partition provided with the supply aperture 190*a*, and the amount of flow Q2 of the developer per unit time delivered from the second transport section to the first transport section at the section other than L/6 so as to investigate the effects of changes in the value of Q2/Q1.

Figure 28:
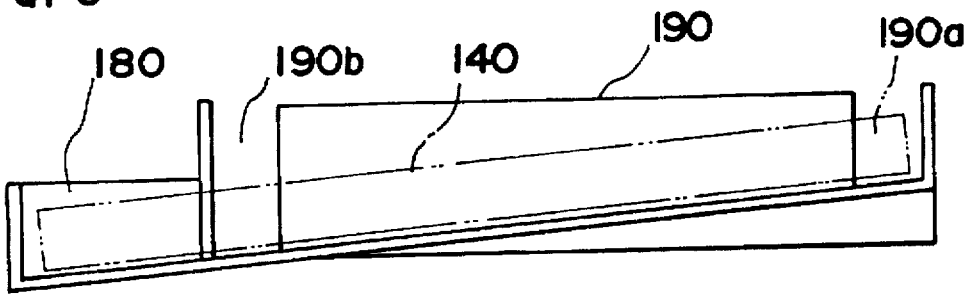
FIG. 28 is an illustration showing the state of the partition in the conventional developing device shown in FIGS. 3–5 when the value of Q2/Q1 is zero (0)
Figure 29:
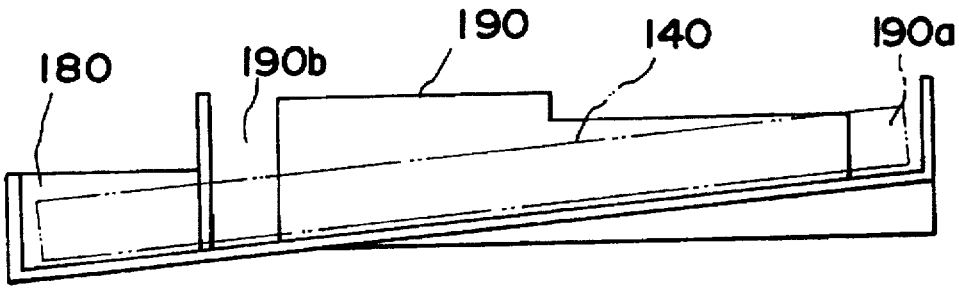
FIG. 29 is an illustration showing the state of the partition in the developing device when the value 0.67.
Figure 30:
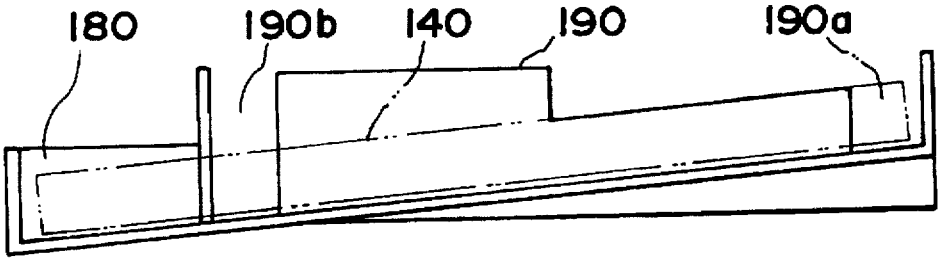
FIG. 30 is an illustration showing the state of the partition in the developing device of the aforesaid embodiment when the value of Q2/Q1 is 1.0.
Figure 31:
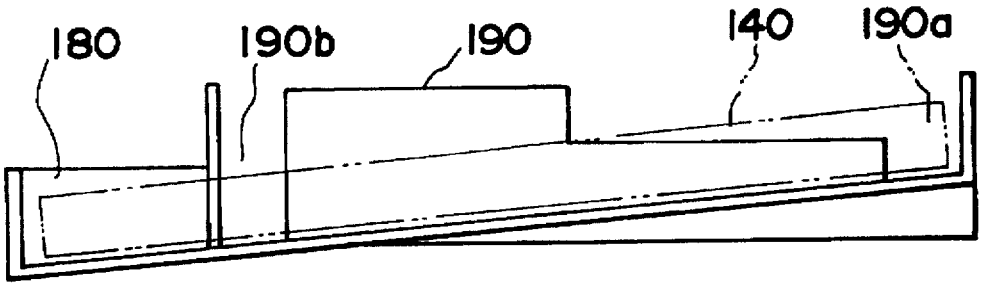
FIG. 31 is an illustration showing the state of the partition in the developing device of another embodiment when the value of Q2/Q1 is 1.8.
Figure 32:
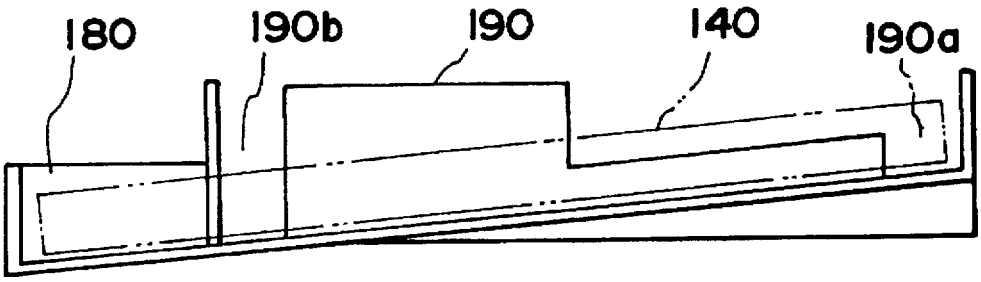
FIG. 32 is an illustration showing the state of the partition in the developing device of still another embodiment when the value of Q2/Q1 is 4.0.
Figure 33:
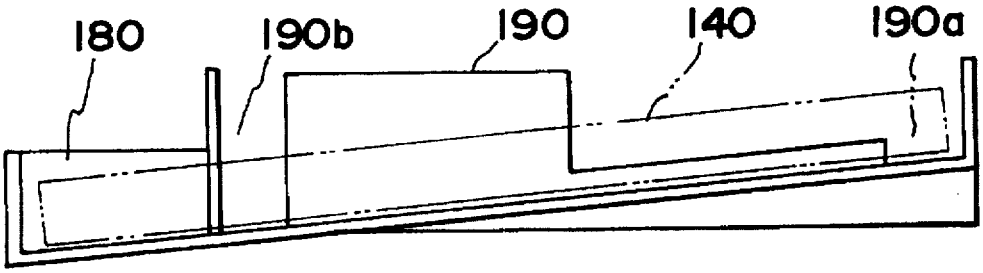
FIG. 33 is an illustration showing the state of the partition in the developing device of yet another embodiment when the value of Q2/Q1 is 8.0.
Figure 34:
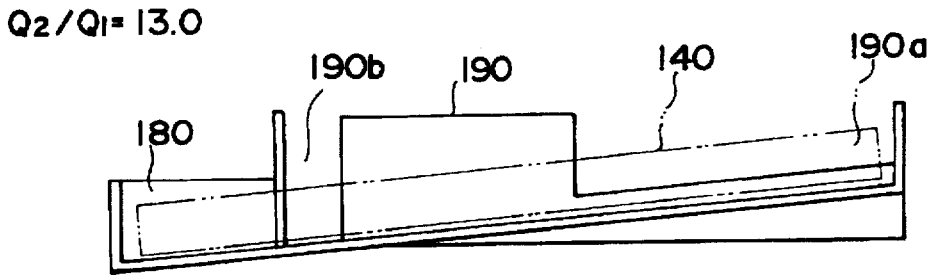
FIG. 34 is an illustration showing the state of the partition in the developing device when the value of Q2/Q1 is 13.0.

In the conventional developing device shown in FIG. 28, the value of the ratio Q2/Q1 is zero (0); and said value is 0.67 in FIG. 29. In the developing device of the sixth embodiment as shown in FIG. 30, the value of Q2/Q1 is 1.0. In the developing device as shown in FIG. 31, the value of Q2/Q1 is 1.5, and said value is 4.0 in FIG. 32, 6.0 in FIG. 33, and 13.0 in FIG. 34.

Figure 40:
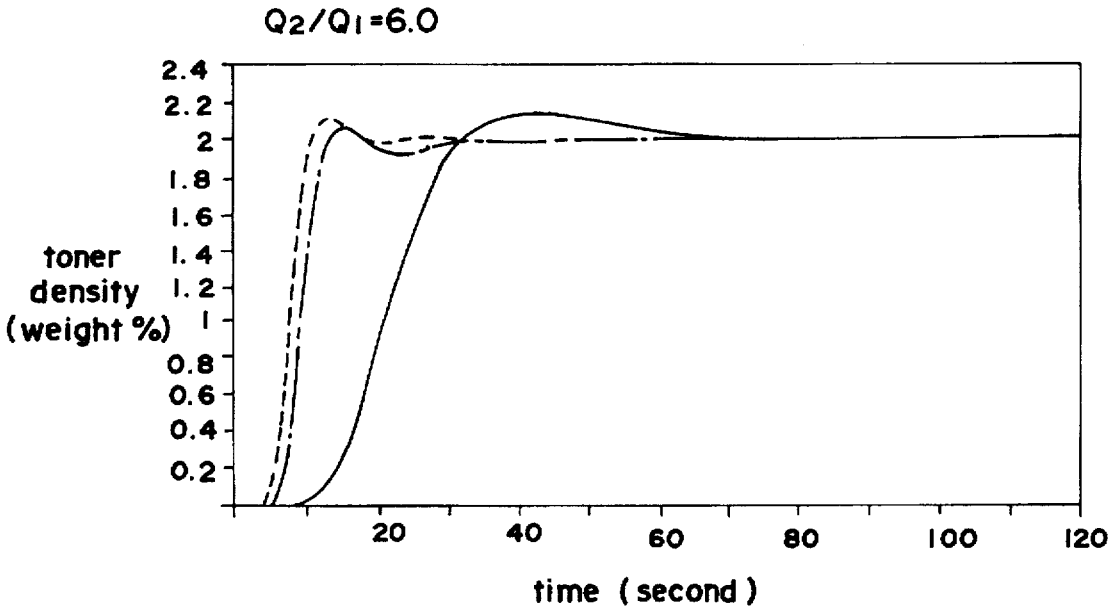
FIG. 40 is an illustration showing the change over time of the toner density in the developer as fresh toner is resupplied from the toner resupply section to the second transport section in the developing device when the value of Q2/Q1 is 6.0.
Figure 41:
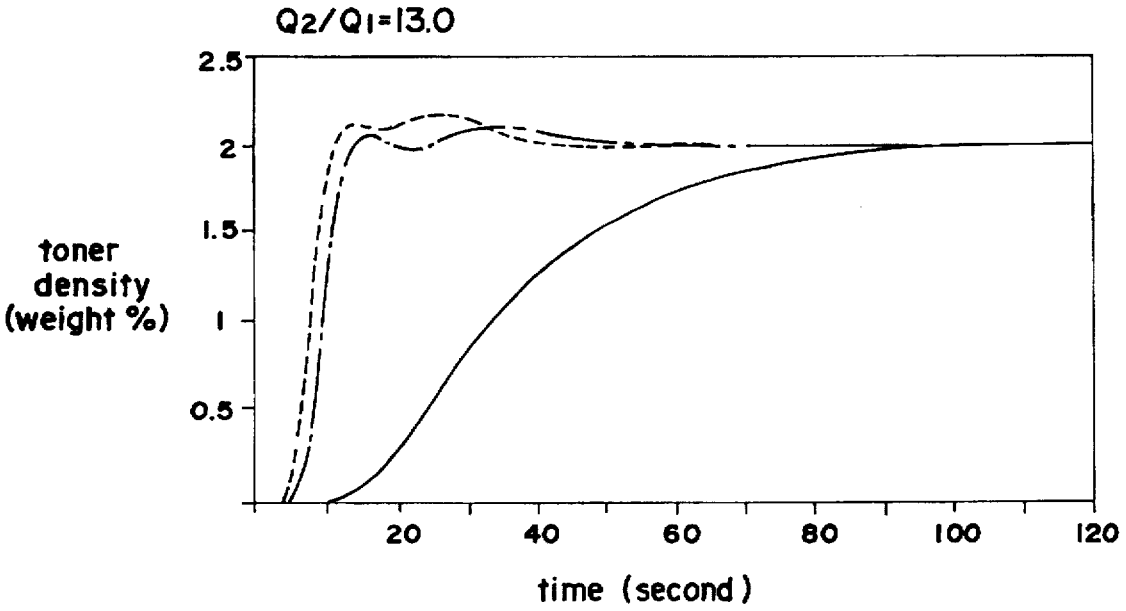
FIG. 41 is an illustration showing the change over time of the toner density in the developer as fresh toner is resupplied from the toner resupply section to the second transport section in the developing device when the value of Q2/Q1 is 13.0.
Figure 42:
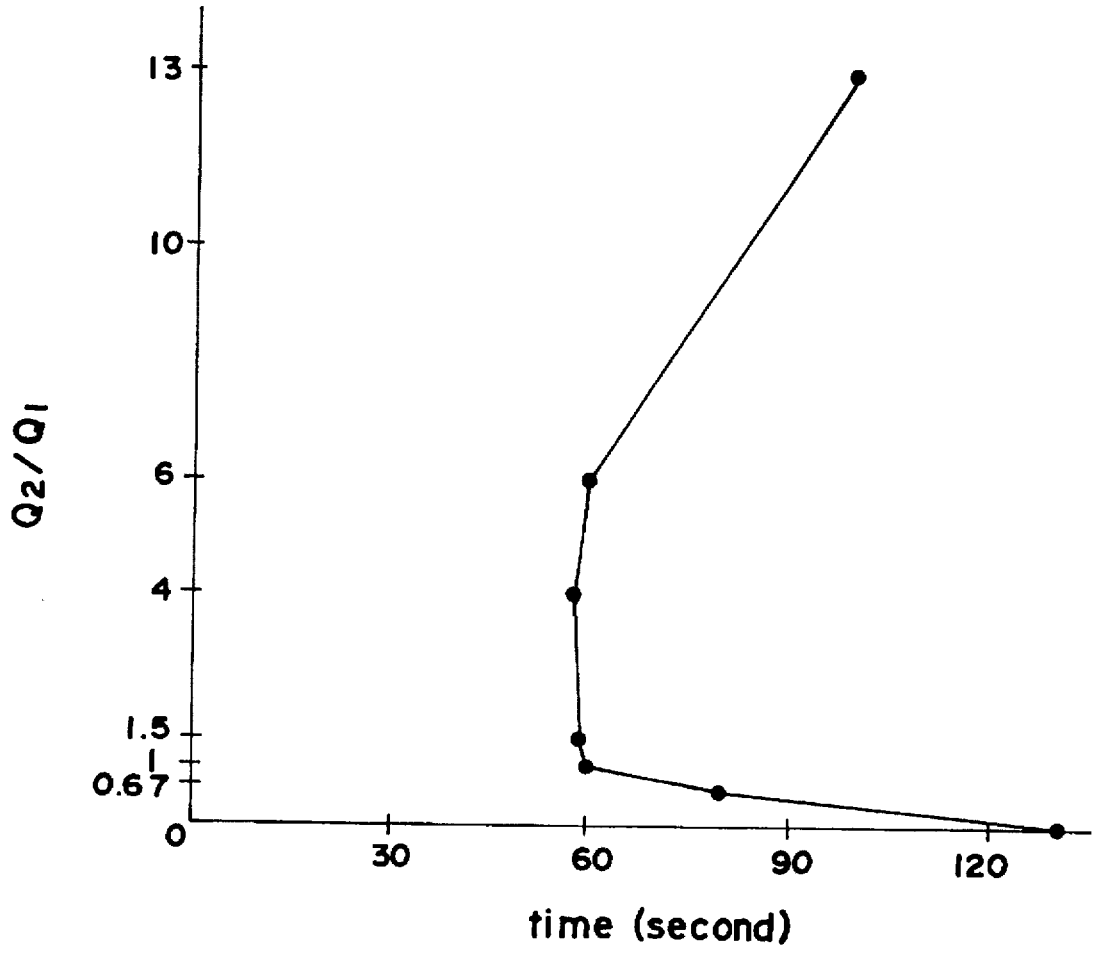
FIG. 42 is an illustration showing the relationships among the values of Q2/Q1 from the scattering of the resupplied toner until the toner density in the developer is stabilized in the developing devices shown in FIGS. 28–34.

In each of the aforesaid developing devices, toner equivalent to 2% by weight relative to the total weight of developer 1 was supplied to the developer supply section 180 provided upstream from the second transport section 150 in the transport direction. Thereafter, the first and second transport rollers 120 and 140 respectively provided in the second transport section 150 and first transport section 130 were rotated, and the toner supplied to the toner supply section 180 is delivered into the second transport section 150. Thus, the developer 1 which has received the resupplied toner is circulated between the second transport section 150 and the first transport section 130. In each of the aforesaid developing devices, toner density in the developer 1 was measured at three locations in the first transport section 130: the upstream position near the supply aperture 190*a* in the direction of developer transport, the center position, and the downstream position near the return aperture 190*b* in the direction of developer transport. The variations in toner density are shown in FIGS. 35–41. Furthermore, the time was measured until stable toner density was achieved in the developer 1 at the aforesaid three locations in each of the developing devices; the relationship between the value of the ratio Q2/Q1 and the time until toner density stabilized is shown in FIG. 42.

Figure 35:
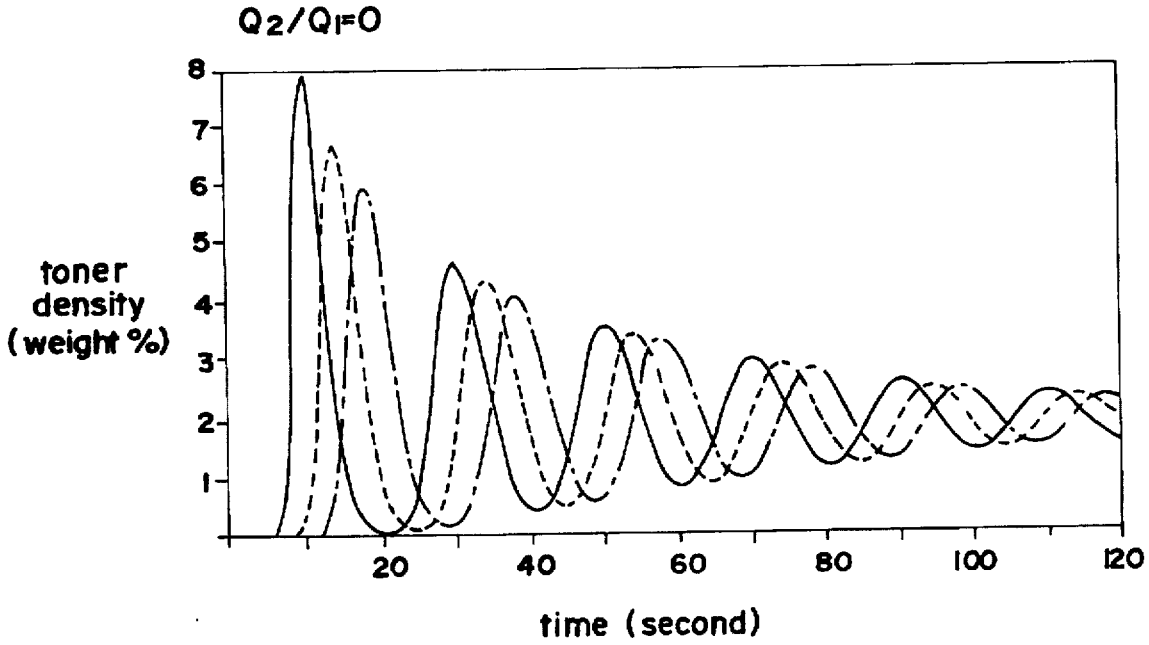
FIG. 35 is an illustration showing the change over time of the toner density in the developer as fresh toner is resupplied from the toner resupply section to the second transport section in the developing device when the value of Q2/Q1 is zero (0)
Figure 36:
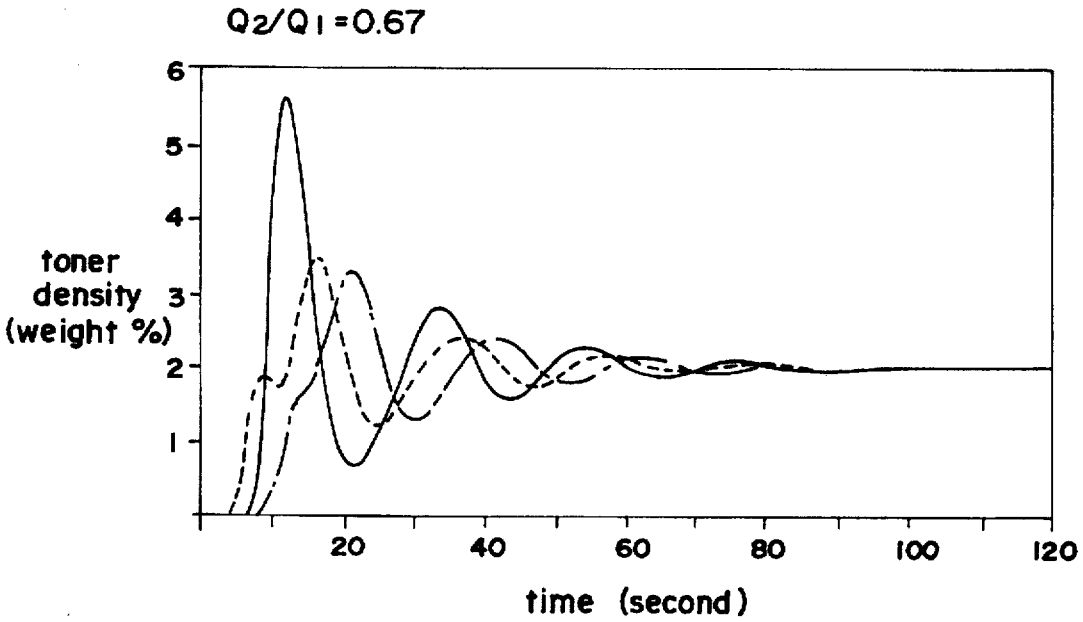
FIG. 36 is an illustration showing the change over time of the toner density in the developer as fresh toner is resupplied from the toner resupply section to the second transport section in the developing device when the value of Q2/Q1 is 0.67.
Figure 37:
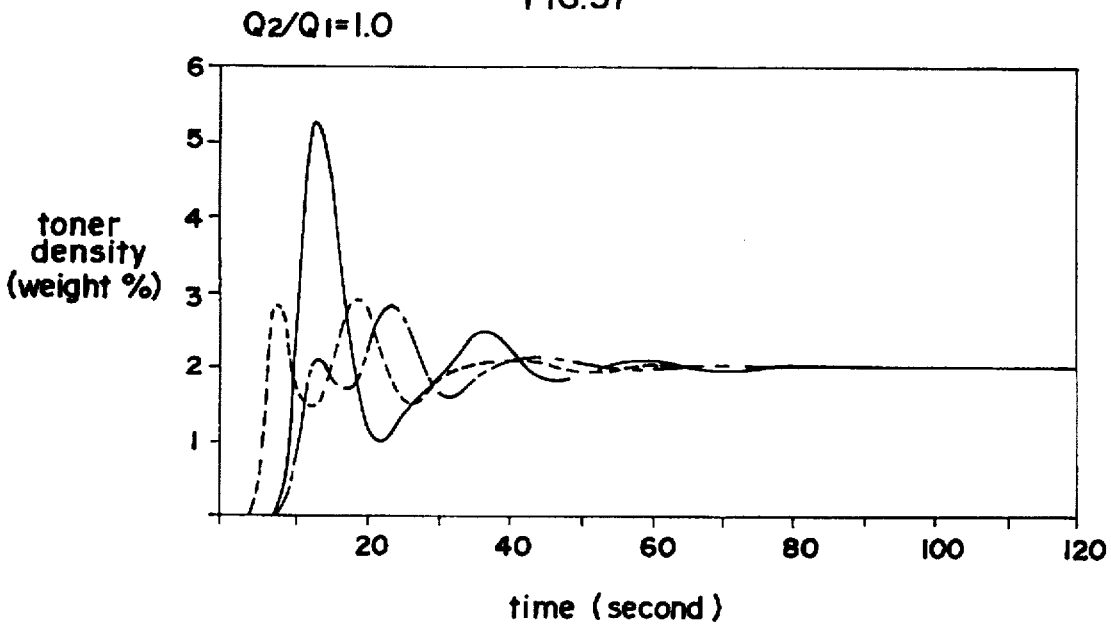
FIG. 37 is an illustration showing the change over time of the toner density in the developer as fresh toner is resupplied from the toner resupply section to the second transport section in the developing device when the value of Q2/Q1 is 1.0.
Figure 38:
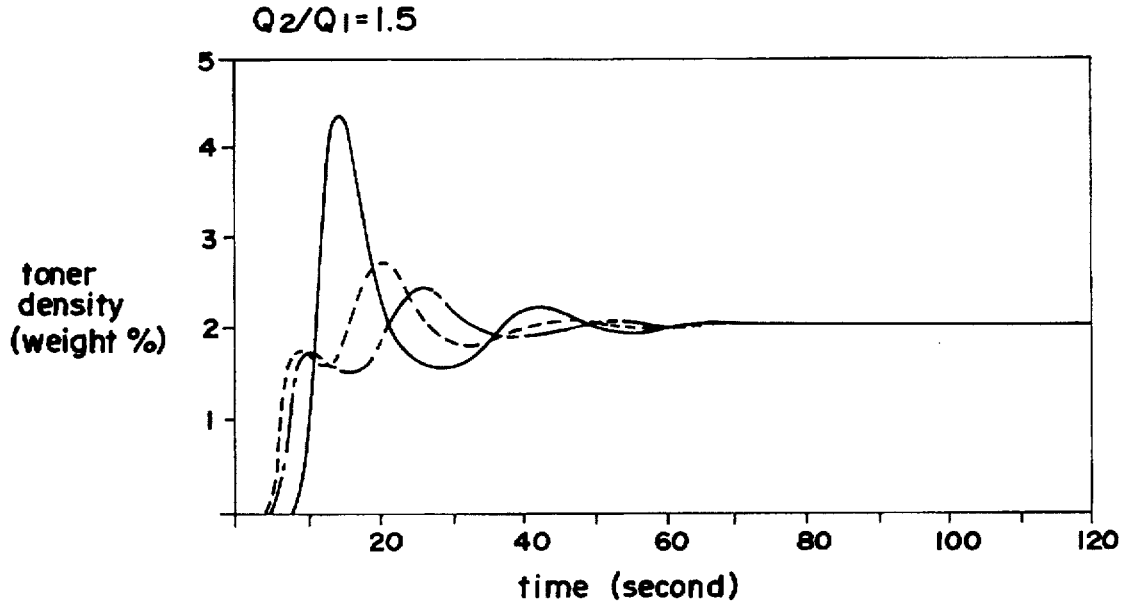
FIG. 38 is an illustration showing the change over time of the toner density in the developer as fresh toner is resupplied from the toner resupply section to the second transport section in the developing device when the value of Q2/Q1 is 1.5.
Figure 39:
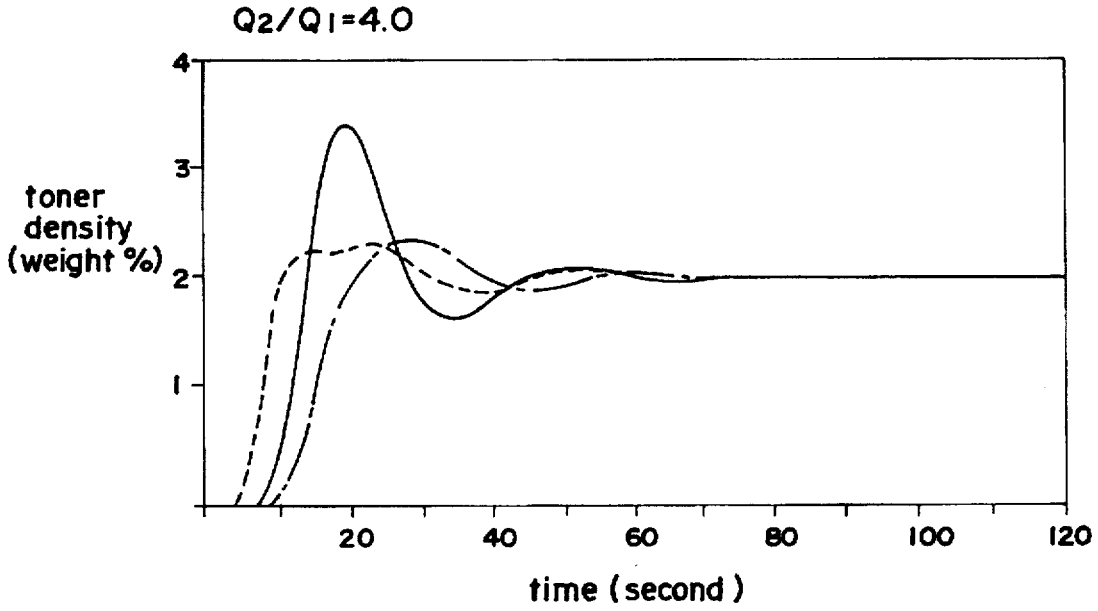
FIG. 39 is an illustration showing the change over time of the toner density in the developer as fresh toner is resupplied from the toner resupply section to the second transport section in the developing device when the value of Q2/Q1 is 4.0.

FIG. 35 shows measurement results for the conventional developing device having a Q2/Q1 value of zero; FIG. 38 shows measurement results with a Q2/Q1 value of 0.67. FIG. 37 shows results for the developing device of the sixth embodiment having a Q2/Q1 value of 1.0; FIG. 38 shows measurement results with a Q2/Q1 value of 1.5; FIG. 39 shows results with a Q2/Q1 value of 4.0; FIG. 40 shows results with a Q2/Q1 value of 8.0; and FIG. 41 shows results with a Q2/Q1 value of 13.0. In the aforesaid drawings, the solid line indicates the change in toner density at the position nearest the supply aperture 190*a*, the dashed line indicates the change in toner density at the center position, and the chain line indicates the change in toner density at the position nearest the return aperture 190*b*.

Figure 43:
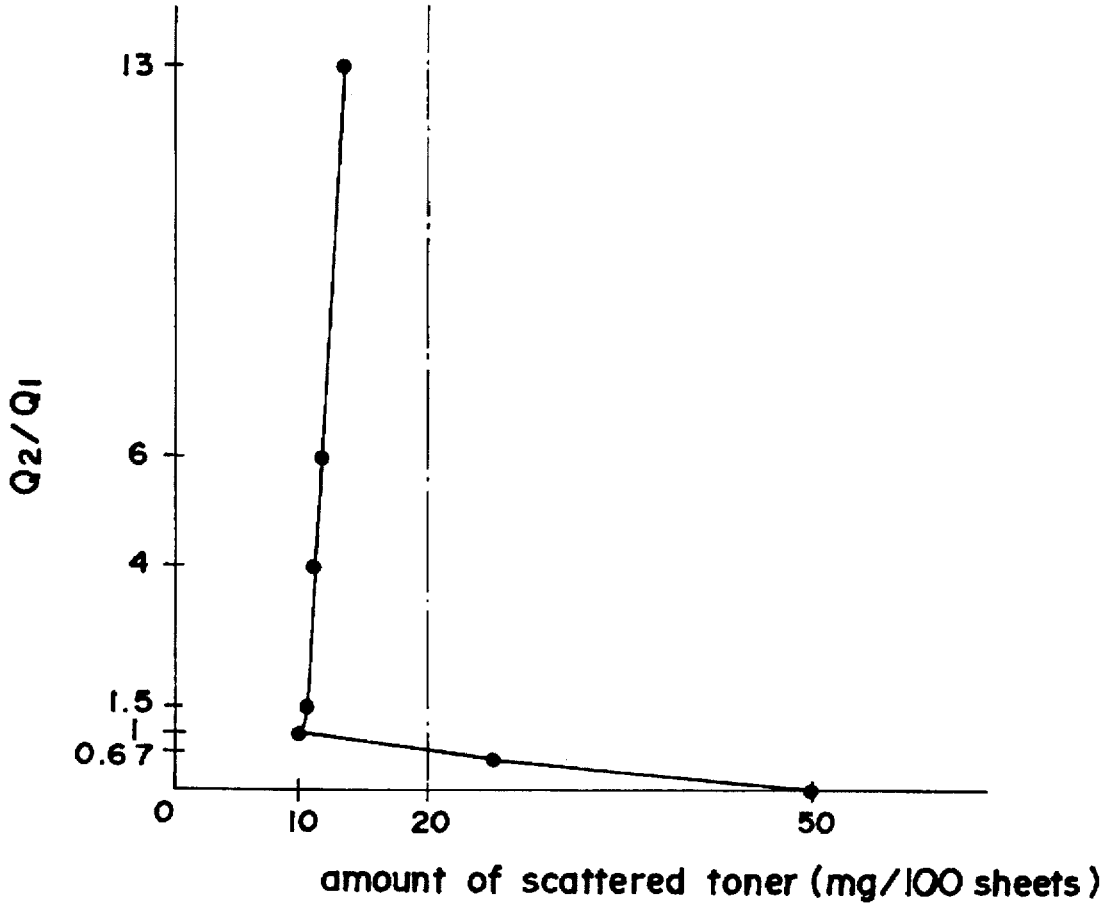
FIG. 43 is an illustration showing the relationships among the values of Q2/Q1 and the amounts of scattered toner when accomplishing development using resupplied toner in each of the developing devices of FIGS. 28–34, on the basis of 1,000 copies.

The amount of toner scattered from each developing device was measured when supplying toner to accomplish development for 1,000 copies. FIG. 43 shows the relationship between the amount of scattered toner per 1,000 copies and the Q2/Q1 value.

As can be clearly understood from the above results that in the conventional developing device shown in FIG. 28 and having a Q2/Q1 value of zero, a longer time is required to disperse the resupplied toner in the developer 1 and attain stable toner density throughout the developer 1 because the developer 1 must circulate 5 times or more between the second transport section 150 and the first transport section 130 until toner density is stabilized, such that more than 120 seconds is required to achieve stable toner density. This situation results in background fogging, and excessive toner scattering of 50 mg per 1,000 copies. The scattered toner causes soiling of the interior of the image forming apparatus which leads to irregular charging.

In comparison to the previously described conventional developing device, the developing device having a value of Q2/Q1 of less than 1, i.e., 0.67, requires a short time to disperse the resupplied toner in the developer 1 and achieving stable toner density throughout the developer 1, and further has less toner scattering. However, 80 seconds or longer is still required to achieve stable toner density throughout the developer 1, and more than 20 mg of scattered toner resulted per 1,000 copies, which is inadequate in regard to the cleaning cycle of the developing device.

On the other hand, while there was scant toner scattering in the developing device with the high value of Q2/Q1, i.e., 13.0, a large amount of developer passes over the partition 190 from the second transport section 150 into the first transport section 130 before the developer 1 having the resupplied toner is conducted to the supply aperture 190*a*. Thus, more than 80 seconds is required to achieve stable toner density throughout the developer 1, and the toner density in the developer 1 at the position near the supply aperture 190*a* is relatively unelevated. During this time, the density of the image formed at the position corresponding to the proximity of the supply aperture 190*a* is reduced, causing nonuniform density in the formed image.

In contrast, in the developing device of the sixth embodiment with a Q2/Q1 value 1.0, and each developing device with a Q2/Q1 value of 1.5, 4.0, and 6.0, the developer 1 receiving the resupplied toner is dispersed, and stable toner density throughout the developer 1 is rapidly achieved during the time required for only two circulations of the developer 1 containing the resupplied toner between the second transport section 150 and the first transport section 130. That is, compared to a conventional developing device, less than half the time, i.e., 60 seconds, is required to achieve stable toner density throughout the developer 1 with marked reduction in background fogging in the formed image, comparatively less toner scattering at 10 mg per 1,000 copies, and no charging irregularities due to toner scattering, with less cleaning necessary.

In each of the previously described developing devices, the height of the partition 190 is adjusted from the end provided with the supply aperture 190*a* to the center portion thereof, thereby changing the amount of developer 1 that passes over the lower portion of the partition 190 from the second transport section 150 to the first transport section 130. Furthermore, the ratio (Q2/Q1) was adjusted between the flow amount Q1 of the developer per unit time delivered from the second transport section 150 to the first transport section 130 at the section L/6 from the end of the partition 190 provided with the supply aperture 190*a*, and the flow amount Q2 of the developer per unit time delivered from the second transport section to the first transport section at the section other than L/6. The adjustment means for achieving the Q2/Q1 value satisfying the relationship $1 \leqq Q2/Q1 < 13$ is not limited to the previously described means.

Figure 44:
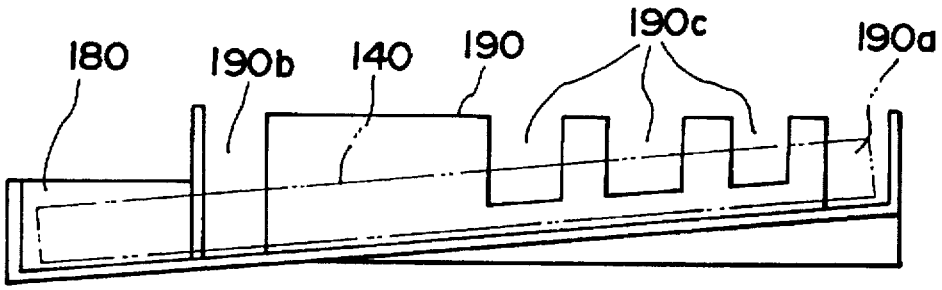
FIG. 44 shows local notches provided in the partition in the developing device of a seventh embodiment of the invention.
Figure 45:
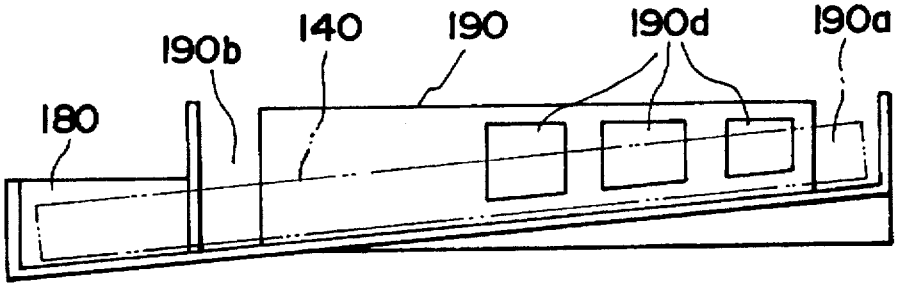
FIG. 45 shows a passage provided in the partition through which the developer passes in the developing device of an eighth embodiment of the invention.

For example, the partition 190 may be provided with a suitably locally notched section 190*c*, as shown in the developing device of the seventh embodiment shown in FIG. 44. The amount of developer 1 passing over the aforesaid notched section 190*c* from the second transport section 150 to the first transport section 130 may be adjusted. Furthermore, passages 190*d* may be provided at suitable positions on the partition 190 to provide openings for the passage of the developer 1 therethrough, as in the developing device of the eighth embodiment shown in FIG. 45. The value of Q2/Q1 may be adjusted to satisfy the relationship $1 \leqq Q2/Q1 < 13$ by adjusting the amount of developer 1 passing through said passages 190*d* from the second transport section 150 to the first transport section 130.

In the developing devices of the sixth through eighth embodiments, a single partition 190 is provided within the housing 100 along the axial direction of the developing sleeve 18, such that said partition 190 separates the first transport section wherein the developer 1 is mixed/transported along the axial direction of the developing sleeve 18, and the second transport section 150 wherein the developer 1 is mixed/transported in the opposite direction relative to the transport direction of the first transport section 130. However, a plurality of partitions 190 may be provided within the housing 100 so as to provide transport sections in addition to the first and second transport sections 130 and 150, such that two adjoining transport sections may be used as the first and second transport sections 130 and 150.

Figure 47:
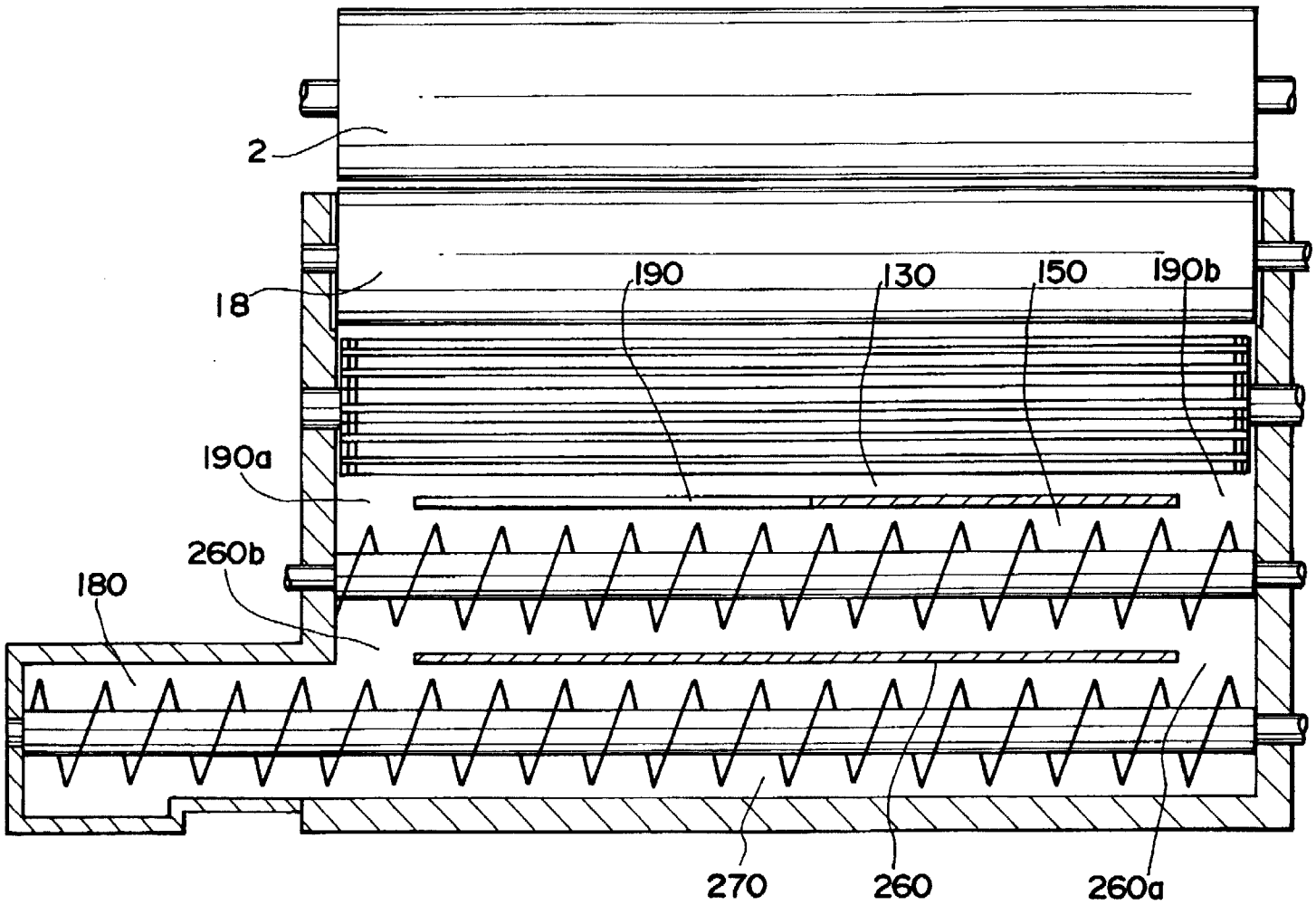
FIG. 47 is a brief top section view showing the interior of the developing device of the ninth embodiment of the invention provided with two partitions within the housing, and having a notch provided from the supply aperture to the center portion of the partition in the top section of said partition disposed at the side of the developing sleeve.
Figure 48:
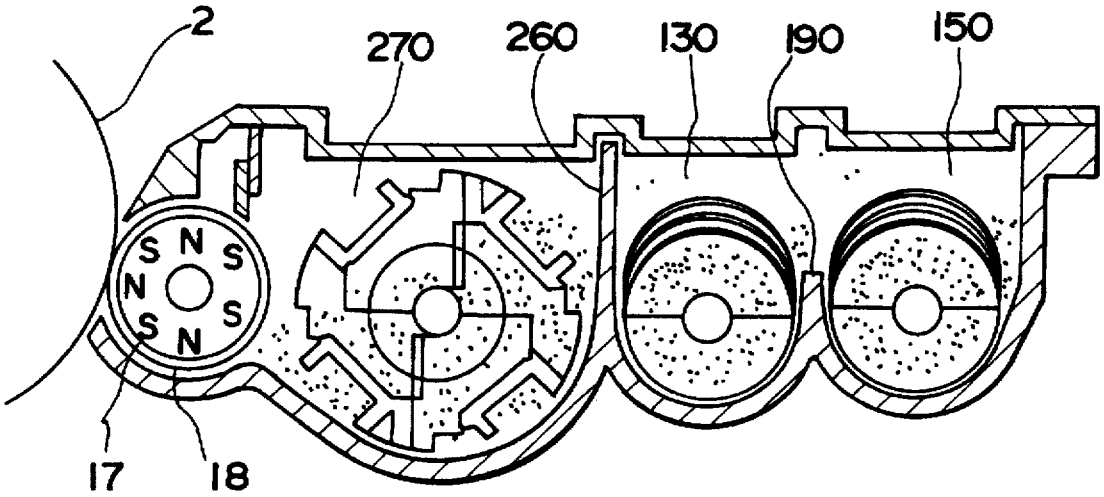
FIG. 48 is a brief side section view showing the interior of the developing device of a tenth embodiment of the invention provided with two partitions within the housing, and having a notch provided from the supply aperture to the center portion of the partition in the top section of said partition disposed at a position removed from the developing sleeve.

For example, in the developing device of a ninth embodiment shown in FIGS. 48 and 47, two partitions 190 and 260 are provided within the housing 100 so as to separate the interior of the housing 100 into three transport sections 130, 150, and 270. The top portion of the partition 190 provided on the developing sleeve 18 side is notched from the supply aperture 190*a* side to the center portion thereof, such that the transport sections are separated into the first and second transport sections 130 and 150 by the said partition 190. The developer 1 which passes over the notched low section of the partition 190 is delivered from the second transport section 150 to the first transport section 130. The relationship between the flow amount Q1 of the developer per unit time delivered from the second transport section 150 to the first transport section 130 at the section L/6 from the end of the partition 190 provided with the supply aperture 190*a*, and the flow amount Q2 of the developer per unit time delivered from the second transport section 150 to the first transport section 130 at the section other than L/6 is adjusted so as to satisfy the following relationship $1 \leqq Q2/Q1 < 13$.

Figure 46:
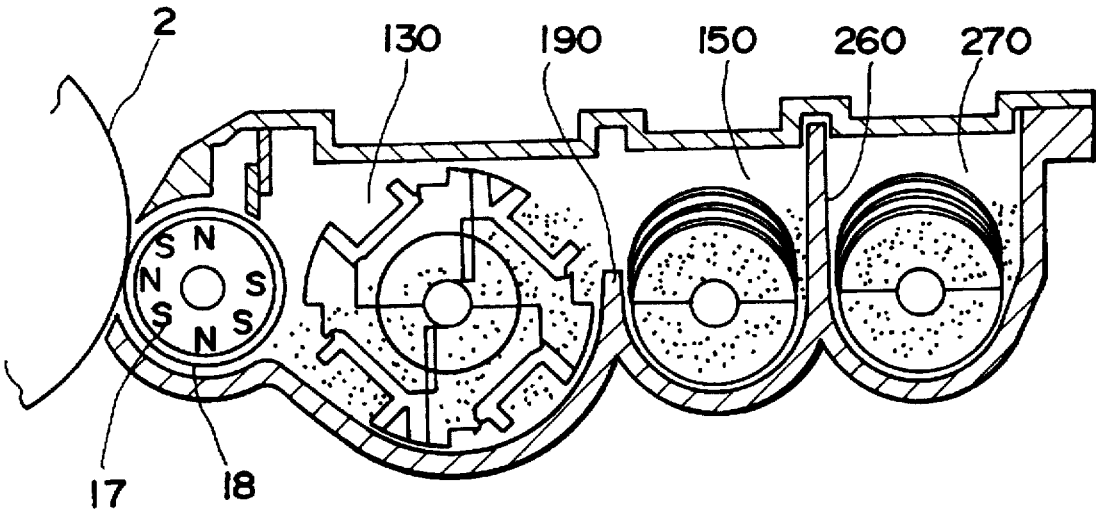
FIG. 46 is a brief side section view showing the interior of the developing device of a ninth embodiment of the invention provided with two partitions within the housing, and having a notch provided from the supply aperture to the center portion of the partition in the top section of said partition disposed at the side of the developing sleeve.

In the developing device of the ninth embodiment shown in FIGS. 46 and 47, the partition 260 is provided at a position separated from the developing sleeve 18 and is higher, such that a toner supply section 180 is provided in the third transport section separated from the second transport section 150 by means of said partition 260. The resupplied toner in the toner supply section 180 is mixed/transported with the developer 1 in the third transport section 170, and said developer 1 is delivered from the supply aperture 260*a* provided at one end of the partition 160 into the second transport section 150. Thus, the delivered developer 1 is transported into the second transport section 150, and into the first transport section 130. A part of the developer 1 is returned through the return aperture 260*b* provided at the other end of the partition 160 into the third transport section 270.

Figure 49:
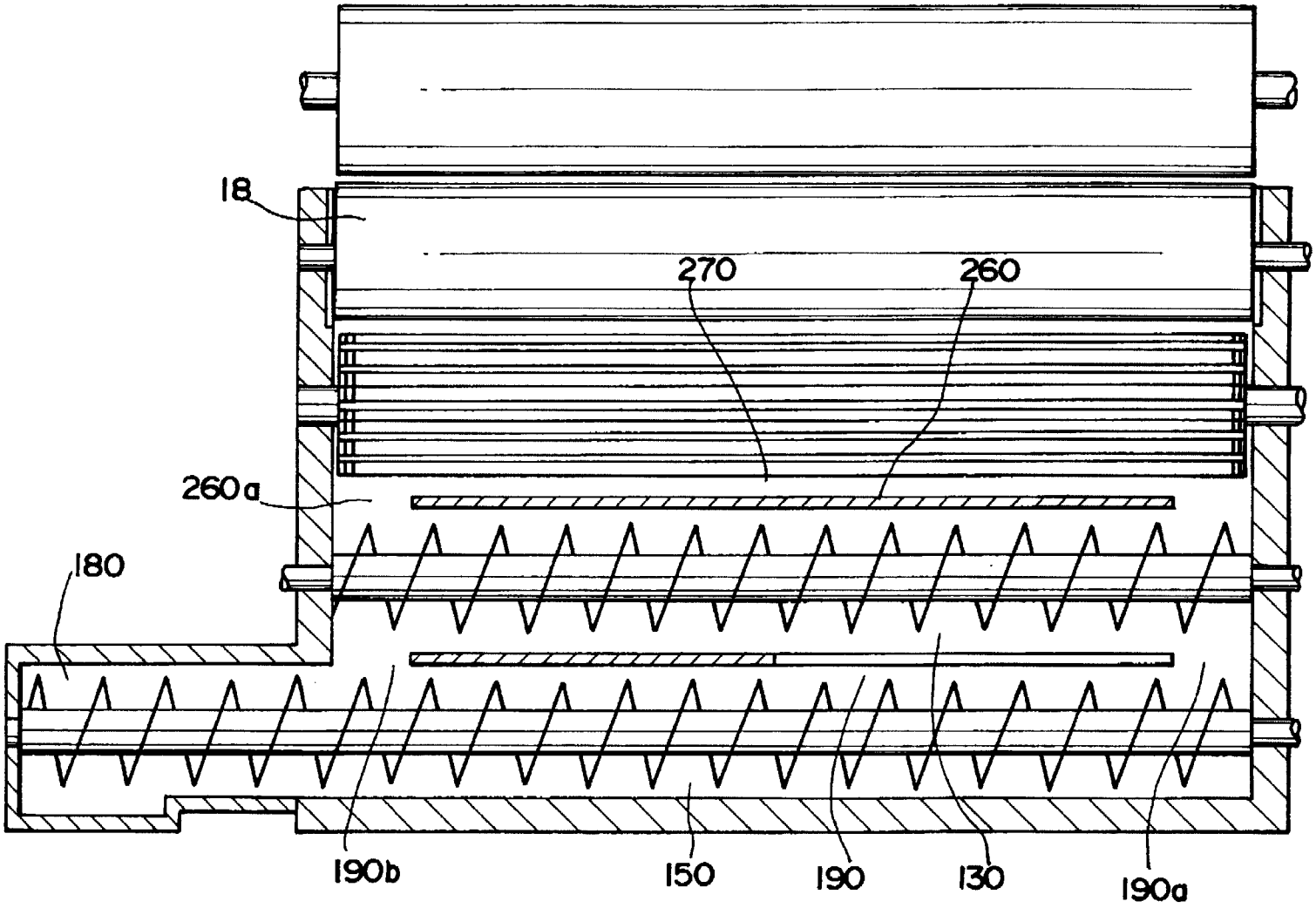
FIG. 49 is a brief top section view showing the interior of the developing device of a tenth embodiment of the invention provided with two partitions within the housing, and having a notch provided From the supply aperture to the center portion of the partition in the top section of said partition disposed at a position removed from the developing sleeve.

FIGS. 48 and 49 show the developing device of a tenth embodiment provided with two partitions 190 and 260 within the housing 100 and which separate the three transport sections 130, 150, and 270 within the housing 100. The top of the partition 190 provided at a position separated from the developing sleeve 18 is notched from the supply aperture 190*a* side to the center portion thereof, said partition 190 separating the first and second transport sections 130 and 150. The developer 1 passes over the low notched section of the partition 190 and is delivered from the second transport section 150 into the first transport section 130. The relationship between the flow amount Q1 of the developer per unit time delivered from the second transport section 150 to the first transport section 130 at the section L/6 from the end of the partition 190 provided with the supply aperture 190*a*, and the flow amount Q2 of the developer per unit time delivered from the second transport section 150 to the first transport section 130 at the section other than L/6 is adjusted so as to satisfy the following relationship $1 \leqq Q2/Q1 < 13$.

In the developing device of the tenth embodiment shown in FIGS. 48 and 49, the height of the partition 260 is higher at a position on the developing sleeve 18 side, and said partition 260 separates the first transport section 130 and the third transport section 270 on the developing sleeve 18 side. The developer 1 transported into the first transport section 130 is delivered through the supply aperture 260*a* provided at one end of the partition 260 into the third transport section 270 for use in development, and said developer 1 passes through the return aperture 190*b* provided at the other end of the partition 190 so as to be returned into the second transport section 150.

Figure 50:
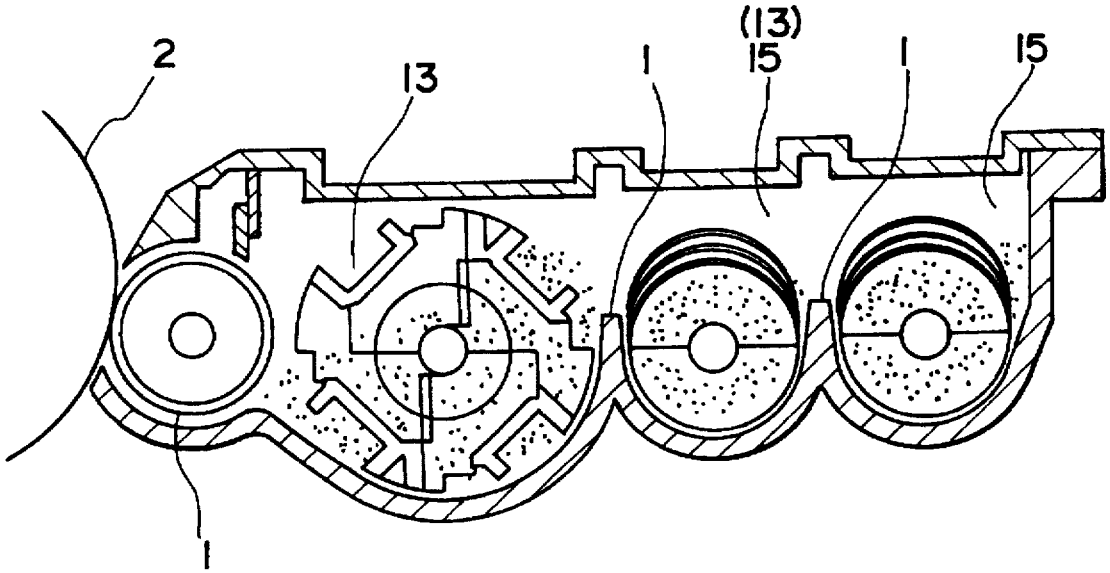
FIG. 50 is a brief side section view showing the interior of the developing device of an eleventh embodiment of the invention provided with two partitions within the housing, and having notch provided from the supply aperture to the center portion at the top section of each partition disposed at a position removed from the developing sleeve.

FIG. 50 shows the developing device of an eleventh embodiment provided with two partitions 190 within the housing 100, the tops of said partitions 190 are notched from the supply aperture 190*a* side to the center portions thereof, and the individual partitions 190 separate the first and second transport sections 130 and 150. The developer 1 passes over the low notched sections of the partitions 190 so as to be delivered from the second transport section 150 into the first transport section 130. The relationship between the flow amount Q1 of the developer per unit time delivered from the second transport section 150 to the first transport section 130 at the section L/6 from the ends of the partitions 190 provided with the supply apertures 190*a*, and the flow amount Q2 of the developer per unit time delivered from the second transport section 150 to the first transport section 130 at the section other than L/6 is adjusted so as to satisfy the following relationship $1 \leqq Q2/Q1 < 13$.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device opposed to a photoreceptor comprising:

a developing sleeve opposed to the photoreceptor and supplying a developer to a surface of the photoreceptor;

a first transport portion adjacent to said developing sleeve wherein the developer is supplied to the sleeve while being transported along the sleeve;

a second transport portion adjacent to said first transport portion wherein the developer is transported in a reverse direction of the developer transport direction in the first transport portion while being mixed, each end of the second transport portion connected to each end of the first transport portion so that the developer is circulated between the first transport portion and the second transport portion;

a toner supply portion provided at an upstream side of the second transport portion with respect to the developer transport direction in the second transport portion and supplying a toner to the second transport portion, the toner supply portion positioned adjacent a toner delivery container which supplies toner directly to the toner supply portion; and a transport member provided in the second transport portion which transports the developer, said transport member transporting the developer at said upstream side of the second transport portion with a speed faster than a transport speed of the developer at a downstream side of the second transport portion and a toner supply speed in said toner supply portion.

2. A developing device as claimed in claim 1 wherein said transport member includes a rotatable shaft through the second transport portion and the toner supply portion as well as an impeller blade provided on an exterior of said shaft, said impeller blade having a spiral configuration with a notch at the downstream side of the second transport portion and the toner supply portion and having a notchless spiral configuration at the upstream side of the second transport portion.

3. A developing device as claimed in claim 1 wherein said transport member includes a rotatable shaft provided through the second transport portion and the toner supply portion as well as an impeller blade provided on an exterior of said shaft, said impeller blade having a spiral configuration with a predetermined pitch at the downstream side of the second transport portion and the toner supply portion and having a spiral configuration with pitch greater than said predetermined pitch at the upstream side of the second transport portion.

4. A developing device opposed to a photoreceptor comprising:

a developing sleeve opposed to the photoreceptor and supplying a developer to a surface of the photoreceptor;

a developer supply portion which is opposed to said developing sleeve and supplies the developer to the sleeve while transporting the developer along the sleeve;

a developer transport portion which is adjacent to said developer supply portion and transports the developer in a reverse direction of the developer transport direction in the developer supply portion while mixing the developer, the developer transport portion supplying developer only to the developer supply portion;

a partition which separates the developer supply portion and the developer transport portion and has an aperture at each end thereof so that the developer is circulated between the developer supply portion and the developer transport portion, said partition having a height so as to allow movement of the developer between the developer supply portion and the developer transport portion;

a first lifting member provided in the developer supply portion; and a second lifting member provided in the developer transport portion, the first lifting member and the second lifting member provided so as not to be opposed to one another through the partition.

5. A developing device as claimed in claim 4 further comprising:

a first transport member provided in the developer supply portion; and a second transport member provided in the developer transport portion, wherein the first transport member and the second transport member each include a rotating shaft and transporting blades provided thereon, and the height of the partition is set lower than ⅓ a radius of one of the first transport member and the second transport member in a vertical direction from a line connecting axial centers of the first transport member and the second transport member.

6. A developing device as claimed in claim 4, further comprising:

a second partition provided above said partition so as to be opposed to the partition with a predetermined interval.

7. A developing device opposed to a photoreceptor comprising:

a developing sleeve opposed to said photoreceptor and supplying a developer to a surface of the photoreceptor;

a developer supply portion which is opposed to said sleeve and supplies the developer to the sleeve while transporting the developer along the sleeve;

a developer transport portion which is adjacent to said developer supply portion and transports the developer in a reverse direction of the developer transport direction in the developer supply portion while mixing the developer, the developer transport portion supplying developer only to the developer supply portion; and a partition which separates the developer supply portion and the developer transport portion and has an aperture at each end thereof so that the developer is circulated between the developer supply portion and the developer transport portion, said partition having a notched portion at an upstream side of the developer transport portion with respect to the developer transport direction in the developer transport portion.

8. A developing device as claimed in claim 7 wherein said partition has the notched portion which extends to a position at least ⅓ of the developer transport portion at the upstream side of the developer transport portion.

9. A developing device as claimed in claim 7, wherein said developed supply portion is provided with a transport roller having a rotating shaft, and the difference in the height of the notched portion of the partition and a height of an axial center position of said rotating shaft $\Delta h$ is set so as to satisfy the relationship of $|\Delta h| \leqq -0.5r$ (r: a radius of the transport roller).

10. A developing device as claimed in claim 7, wherein the notched portion allows developer to pass over the notched portion of the partition from the developer supply section to the developer transport section.

11. A developing device opposed to a photoreceptor comprising:

a developing sleeve opposed to said photoreceptor and supplying a developer to a surface of the photoreceptor;

a developer supply portion which is opposed to said developing sleeve and supplies the developer to the sleeve while transporting the developer along the sleeve;

a developer transport portion which is adjacent to said developer supply portion and transports the developer in a reverse direction of the developer transport direction in the developer supply portion while mixing the developer, the developer transport portion supplying developer only to the developer supply portion; and a partition which separates the developer supply portion and the developer transport portion and has an aperture at each end thereof so that the developer is circulated between the developer supply portion and the developer transport portion, said partition having a continuous notched portion beginning at an end of the partition at a downstream side of the developer transport portion with respect to the developer transport direction in the developer transport portion, said notched portion continuing to a location at a downstream side of the developer transport portion.

12. A developing device as claimed in claim 11 wherein a flow amount Q1 of the developer per unit time delivered from the developer transport portion to the developer supply portion at a section L/6 from the end of the partition provided with the aperture through which the developer is supplied from the developer transport portion to the developer supply portion, and a flow amount Q2 of the developer per unit time delivered from the developer transport portion to the developer supply portion at a section other than L/6 is set so as to satisfy the relationship of $1 \leqq Q2/Q1 < 13$ when a length of each of the developer supply transport portion and the developer transport portion is designated L.

13. A developing device as claimed in claim 11, wherein the notched portion allows developer to pass over the notched portion of the partition from the developer transport portion to the developer supply portion.

14. A developing device opposed to a photoreceptor comprising:

a developing sleeve opposed to said photoreceptor and supplying a developer to a surface of the photoreceptor;

a developer supply portion which is opposed to said developing sleeve and supplies the developer to the sleeve while transporting the developer along the sleeve;

a developer transport portion which is adjacent to said developer supply portion and transports the developer in a reverse direction of the developer transport direction in the developer supply portion while mixing the developer, the developer transport portion supplying the developer only to the developer supply portion; and a partition which separates the developer supply portion and the developer transport portion and has an aperture at each end thereof so that the developer is circulated between the developer supply portion and the developer transport portion, said partition having a plurality of notched portions at a downstream side of the developer transport portion with respect to the developer transport direction in the developer transport portion.

15. A developing device as claimed in claim 14 wherein a flow amount Q1 of the developer per unit time delivered from the developer transport portion to the developer supply portion at a section L/6 from the end of the partition provided with the aperture through which the developer is supplied from the developer transport portion to the developer supply portion, and a flow amount Q2 of the developer per unit time delivered from the developer supply transport portion to the developer supply portion at a section other than L/6 is set so as to satisfy the relationship of $1 \leqq Q1/Q1 < 13$ when a length of each of the developer supply portion and the developer transport portion is designated L.

16. A developing device as claimed in claim 14, wherein the plurality of notched portions allow developer to pass over the notched portions of the partition from the developer transport portion to the developer supply portion.

17. A developing device opposed to a photoreceptor comprising:

a developing sleeve opposed to said photoreceptor and supplying a developer to a surface of the photoreceptor;

a developer supply portion which is opposed to said developing sleeve and supplies the developer to the sleeve while transporting the developer along the sleeve;

a developer transport portion which is adjacent to said developer supply portion and transports the developer in a reverse direction of the developer transport direction in the developer supply portion while mixing the developer, the developer transport portion supplying developer only to the developer supply portion; and a partition which separates the developer supply portion and the developer transport portion and has an aperture at each end thereof, so that the developer is circulated between the developer supply portion and the developer transport portion, said partition having a plurality of openings for the passage of the developer at a downstream side of the developer transport portion with respect to the developer transport direction in the developer transport portion.

18. A developing device as claimed in claim 17 wherein a flow amount Q1 of the developer per unit time delivered from the developer transport portion to the developer supply portion at a section L/6 from the end of the partition provided with the aperture through which the developer is supplied from the developer transport portion to the developer supply portion, and a flow amount Q2 of the developer per unit time delivered from the developer transport portion to the developer supply portion at a section other than L/6 is set so as to satisfy the relationship of $1 \leqq Q2/Q1 < 13$ when a length of each of the developer supply portion and the developer transport portion is designated L.

19. A developing device opposed to a photoreceptor comprising:

a developing sleeve opposed to said photoreceptor and supplying a developer to a surface of the photoreceptor;

a developer supply portion which is opposed to said developing sleeve and supplies the developer to the sleeve while transporting the developer along the sleeve;

a first developer transport portion which is adjacent to said developer supply portion and transports the developer in a reverse direction of the developer transport direction in the developer supply portion while mixing the developer, the first developer transport portion supplying developer only to the developer supply portion;

a second developer transport portion which is adjacent to said first developer transport portion and transports the developer to be supplied in the same direction as the developer transport direction in the developer supply portion while mixing the developer;

a first partition which separates the developer supply portion and the first developer transport portion and has an aperture at each end thereof, said first partition having a notched portion at a downstream side of the first developer transport portion with respect to the developer transport direction in the first developer transport portion; and a second partition which separates the first developer transport portion and the second developer transport portion and has an aperture at each end thereof so that the developer is circulated among developer supply portion, the first developer transport portion, and the second developer transport portion.

20. A developing device as claimed in claim 19, wherein the notched portion allows developer to pass over the notched portion of the partition from the developer transport portion to the developer supply portion.

21. A developing device opposed to a photoreceptor comprising:

a developing sleeve opposed to said photoreceptor and supplying a developer to a surface of the photoreceptor;

a developer supply portion which is opposed to said developing sleeve and supplies the developer to the sleeve while transporting the developer along the sleeve;

a first developer transport portion which is adjacent to said developer supply portion and transports the developer in a reverse direction of the developer transport direction in the developer supply portion while mixing the developer, the first developer transport portion supplying developer only to the developer supply portion;

a second developer transport portion which is adjacent to said first developer transport portion and transports the developer in the same direction as the developer transport direction in the developer supply portion while mixing the developer;

a first partition which separates the developer supply portion and the first developer transport portion and has an aperture at each end thereof; and a second partition, which separates the first developer transport portion and the second developer transport portion and has an aperture at each end thereof so that the developer is circulated among the developer supply portion, the first developer transport portion, and the second developer transport portion, said second partition having a notched portion at a downstream side of the second developer transport portion with respect to the developer transport direction in the second developer transport portion.

22. A developing device for supplying a developer to a photoreceptor, said developing device comprising:

a developing member opposed to the photoreceptor;

a developer circulating path having a first portion opposed to the developing member and a second portion adjacent to said first portion;

a first transport member provided in said first portion and supplying the developer to the developing member while transporting the developer in a predetermined direction;

a second transport member provided in said second portion and transporting the developer in a reverse direction of the transport direction by said first transport member while mixing the developer with toner particles supplied to the second portion; and a change member which changes a transport speed by the second transport member, so that the second transport member transports the developer at a first speed for a predetermined period following the receipt of the toner particles supplied to the second portion at a second speed, and thereafter transports the developer at a third speed, the first speed being higher than the second and third speeds.

23. A developing device as claimed in claim 22 wherein said second speed is equal to said third speed.

* * * * *